US010883051B2

(12) United States Patent
Quanci et al.

(10) Patent No.: US 10,883,051 B2
(45) Date of Patent: Jan. 5, 2021

(54) METHODS AND SYSTEMS FOR IMPROVED COKE QUENCHING

(71) Applicant: SunCoke Technology and Development LLC., Lisle, IL (US)

(72) Inventors: John Francis Quanci, Haddonfield, NJ (US); John Shannon Essman, Wheelersburg, OH (US); James Eric Bond, Portsmouth, OH (US); Khambath Vichitvongsa, Marysville, IL (US); Chun Wai Choi, Chicago, IL (US)

(73) Assignee: SUNCOKE TECHNOLOGY AND DEVELOPMENT LLC, Lisle, IL (US)

( * ) Notice: Subject to any disclaimer, the term of this patent is extended or adjusted under 35 U.S.C. 154(b) by 1231 days.

(21) Appl. No.: 13/730,796

(22) Filed: Dec. 28, 2012

(65) Prior Publication Data

US 2014/0182195 A1 Jul. 3, 2014

(51) Int. Cl.
*C10B 39/00* (2006.01)
*C10B 39/12* (2006.01)
(Continued)

(52) U.S. Cl.
CPC ..... *C10B 39/12* (2013.01); *C10B 39/04* (2013.01); *C10B 39/14* (2013.01)

(58) Field of Classification Search
CPC ..... C10L 9/08; C10L 9/09; C10L 5/28; C10B 39/00; C10B 39/12
See application file for complete search history.

(56) References Cited

U.S. PATENT DOCUMENTS 425,797 A 4/1890 Hunt
469,868 A 3/1892 Thomas et al.
(Continued)

FOREIGN PATENT DOCUMENTS

CA 1172895 8/1984
CA 2775992 A1 5/2011
(Continued)

OTHER PUBLICATIONS

Crelling, et al., "Effects of Weathered Coal on Coking Properties and Coke Quality", Fuel, 1979, vol. 58, Issue 7, pp. 542-546.
(Continued)

*Primary Examiner* — Ellen M McAvoy
*Assistant Examiner* — Ming Cheung Po
(74) *Attorney, Agent, or Firm* — Perkins Coie LLP

(57) ABSTRACT

The present technology describes various embodiments of methods and systems for improved coke quenching. More specifically, some embodiments are directed to methods and systems for improving the coke quenching process by partially cracking coke before it is quenched. In one embodiment, coke is partially cracked when placed in horizontal communication with one or more uneven surfaces. In another embodiment, a coke loaf is partially broken when dropped a vertical distance that is less than the height of the coke loaf. In another embodiment, a mass of coke is partially broken when first placed in vertical communication with one or more uneven surfaces and then placed in horizontal communication with the same or different one or more uneven surfaces. In some embodiments, the one or more uneven surfaces may be mounted to a coke oven, train car, hot car, quench car, or combined hot car/quench car.

23 Claims, 10 Drawing Sheets

(51) Int. Cl.
*C10B 39/04* (2006.01)
*C10B 39/14* (2006.01)

(56) References Cited

U.S. PATENT DOCUMENTS 976,580 A 7/1909 Krause
1,140,798 A 5/1915 Carpenter
1,424,777 A 8/1922 Schondeling
1,430,027 A 9/1922 Plantinga
1,486,401 A 3/1924 Van Ackeren
1,572,391 A 2/1926 Klaiber
1,677,973 A 7/1928 Marquard
1,721,813 A 7/1929 Geipert et al.
1,818,370 A 8/1931 Wine
1,818,994 A 8/1931 Kreisinger
1,848,818 A 3/1932 Becker
1,955,962 A 4/1934 Jones
2,075,337 A 3/1937 Burnaugh
2,394,173 A 2/1946 Harris et al.
2,424,012 A 7/1947 Bangham et al.
2,667,185 A 1/1954 Beavers
2,723,725 A 11/1955 Keiffer
2,756,842 A 7/1956 Chamberlin et al.
2,873,816 A 2/1959 Emil et al.
2,902,991 A 9/1959 Whitman
3,015,893 A 1/1962 McCreary
3,033,764 A 5/1962 Hannes
3,462,345 A 8/1969 Kernan
3,511,030 A 5/1970 Brown et al.
3,542,650 A 11/1970 Kulakov
3,545,470 A 12/1970 Paton
3,592,742 A 7/1971 Thompson
3,616,408 A 10/1971 Hickam
3,630,852 A 12/1971 Nashan et al.
3,652,403 A 3/1972 Knappstein et al.
3,676,305 A 7/1972 Cremer
3,709,794 A 1/1973 Kinzler et al.
3,710,551 A 1/1973 Sved
3,746,626 A 7/1973 Morrison, Jr.
3,748,235 A 7/1973 Pries
3,784,034 A 1/1974 Thompson
3,806,032 A 4/1974 Pries
3,836,161 A 9/1974 Buhl
3,839,156 A 10/1974 Jakobi et al.
3,844,900 A 10/1974 Schulte
3,857,758 A 12/1974 Mole
3,875,016 A 4/1975 Schmidt-Balve et al.
3,876,506 A 4/1975 Dix et al.
3,878,053 A 4/1975 Hyde
3,894,302 A 7/1975 Lasater
3,897,312 A 7/1975 Armour et al.
3,906,992 A 9/1975 Leach
3,912,091 A 10/1975 Thompson
3,917,458 A 11/1975 Polak
3,930,961 A 1/1976 Sustarsic et al.
3,957,591 A 5/1976 Riecker
3,959,084 A 5/1976 Price
3,963,582 A 6/1976 Helm et al.
3,969,191 A 7/1976 Bollenbach et al.
3,975,148 A 8/1976 Fukuda et al.
3,984,289 A 10/1976 Sustarsic et al.
4,004,702 A 1/1977 Szendroi
4,004,983 A 1/1977 Pries
4,040,910 A 8/1977 Knappstein et al.
4,045,299 A 8/1977 MacDonald
4,059,885 A 11/1977 Oldengott
4,067,462 A 1/1978 Thompson
4,083,753 A 4/1978 Rogers et al.
4,086,231 A 4/1978 Ikio
4,093,245 A 6/1978 Connor
4,100,033 A 7/1978 Holter
4,111,757 A 9/1978 Ciarimboli
4,124,450 A 11/1978 MacDonald
4,141,796 A 2/1979 Clark et al.
4,145,195 A 3/1979 Knappstein et al.
4,147,230 A 4/1979 Ormond et al.
4,162,546 A 7/1979 Shorten et al.
4,181,459 A 1/1980 Price
4,189,272 A 2/1980 Gregor et al.
4,194,951 A 3/1980 Pries
4,196,053 A 4/1980 Grohmann
4,211,608 A 7/1980 Kwasnoski et al.
4,211,611 A 7/1980 Bocsanczy et al.
4,213,489 A 7/1980 Cain
4,213,828 A 7/1980 Calderon
4,222,748 A 9/1980 Argo et al.
4,222,824 A 9/1980 Flockenhaus et al.
4,224,109 A 9/1980 Flockenhaus et al.
4,225,393 A 9/1980 Gregor et al.
4,235,830 A 11/1980 Bennett et al.
4,248,671 A 2/1981 Belding
4,249,997 A 2/1981 Schmitz
4,263,099 A 4/1981 Porter
4,285,772 A 8/1981 Kress
4,287,024 A 9/1981 Thompson
4,289,584 A 9/1981 Chuss et al.
4,289,585 A 9/1981 Wegener et al.
4,302,935 A 12/1981 Cousimano
4,303,615 A 12/1981 Jarmell et al.
4,307,673 A 12/1981 Caughey
4,314,787 A 2/1982 Kwasnik et al.
4,330,372 A 5/1982 Cairns et al.
4,334,963 A 6/1982 Stog
4,336,843 A 6/1982 Petty
4,340,445 A 7/1982 Kucher et al.
4,342,195 A 8/1982 Lo
4,344,820 A 8/1982 Thompson
4,344,822 A 8/1982 Schwartz et al.
4,366,029 A 12/1982 Bixby et al.
4,373,244 A 2/1983 Mertens et al.
4,375,388 A 3/1983 Hara et al.
4,391,674 A * 7/1983 Velmin ..... C10B 33/003 201/41
4,392,824 A 7/1983 Struck et al.
4,395,269 A 7/1983 Schuler
4,396,394 A 8/1983 Li et al.
4,396,461 A 8/1983 Neubaum et al.
4,431,484 A 2/1984 Weber et al.
4,439,277 A 3/1984 Dix
4,440,098 A 4/1984 Adams
4,445,977 A 5/1984 Husher
4,446,018 A 5/1984 Cerwick
4,448,541 A 5/1984 Wirtschafter
4,452,749 A 6/1984 Kolvek et al.
4,459,103 A 7/1984 Gieskieng
4,469,446 A 9/1984 Goodboy
4,474,344 A 10/1984 Bennett
4,487,137 A 12/1984 Horvat et al.
4,498,786 A 2/1985 Ruscheweyh
4,506,025 A 3/1985 Kleeb et al.
4,508,539 A 4/1985 Nakai
4,527,488 A 7/1985 Lindgren
4,568,426 A 2/1986 Orlando et al.
4,570,670 A 2/1986 Johnson
4,614,567 A 9/1986 Stahlherm et al.
4,643,327 A 2/1987 Campbell
4,645,513 A 2/1987 Kubota et al.
4,655,193 A 4/1987 Blacket
4,655,804 A 4/1987 Kercheval et al.
4,666,675 A 5/1987 Parker et al.
4,680,167 A 7/1987 Orlando et al.
4,704,195 A 11/1987 Janicka et al.
4,720,262 A 1/1988 Durr et al.
4,726,465 A 2/1988 Kwasnik et al.
4,793,981 A 12/1988 Doyle et al.
4,824,614 A 4/1989 Jones et al.
4,919,170 A 4/1990 Kallinich et al.
4,929,179 A 5/1990 Breidenbach et al.
4,941,824 A 7/1990 Holter et al.
5,052,922 A 10/1991 Stokman et al.
5,062,925 A 11/1991 Durselen et al.
5,078,822 A 1/1992 Hodges et al.
5,087,328 A 2/1992 Wegerer et al.
5,114,542 A 5/1992 Childress et al.

(56) References Cited

U.S. PATENT DOCUMENTS

| | | | |
|---|---|---|---|
| 5,227,106 | A | 7/1993 | Kolvek |
| 5,228,955 | A | 7/1993 | Westbrook, III |
| 5,318,671 | A | 6/1994 | Pruitt |
| 5,423,152 | A | 6/1995 | Kolvek |
| 5,447,606 | A | 9/1995 | Prutt et al. |
| 5,480,594 | A | 1/1996 | Wilkerson et al. |
| 5,622,280 | A | 4/1997 | Mays et al. |
| 5,659,110 | A | 8/1997 | Herden et al. |
| 5,670,025 | A | 9/1997 | Baird |
| 5,687,768 | A | 11/1997 | Albrecht et al. |
| 5,787,821 | A | 8/1998 | Bhat et al. |
| 5,810,032 | A | 9/1998 | Hong et al. |
| 5,857,308 | A | 1/1999 | Dismore et al. |
| 5,928,476 | A | 7/1999 | Daniels |
| 5,968,320 | A | 10/1999 | Sprague |
| 6,017,214 | A | 1/2000 | Sturgulewski |
| 6,059,932 | A | 5/2000 | Sturgulewski |
| 6,139,692 | A | 10/2000 | Tamura et al. |
| 6,152,668 | A | 11/2000 | Knoch |
| 6,187,148 | B1 | 2/2001 | Sturgulewski |
| 6,189,819 | B1 | 2/2001 | Racine |
| 6,290,494 | B1 | 9/2001 | Barkdoll |
| 6,596,128 | B2 | 7/2003 | Westbrook |
| 6,626,984 | B1 | 9/2003 | Taylor |
| 6,699,035 | B2 | 3/2004 | Brooker |
| 6,758,875 | B2 | 7/2004 | Reid et al. |
| 6,907,895 | B2 | 6/2005 | Johnson et al. |
| 6,946,011 | B2 | 9/2005 | Snyder |
| 6,964,236 | B2 | 11/2005 | Schucker |
| 7,056,390 | B2 | 6/2006 | Fratello et al. |
| 7,077,892 | B2 | 7/2006 | Lee |
| 7,314,060 | B2 | 1/2008 | Chen et al. |
| 7,331,298 | B2 | 2/2008 | Taylor et al. |
| 7,497,930 | B2 | 3/2009 | Barkdoll et al. |
| 7,611,609 | B1 | 11/2009 | Valia et al. |
| 7,644,711 | B2 | 1/2010 | Creel |
| 7,727,307 | B2 | 6/2010 | Winkler |
| 7,803,627 | B2 | 9/2010 | Hodges |
| 7,827,689 | B2 | 11/2010 | Crane et al. |
| 7,998,316 | B2 | 8/2011 | Barkdoll et al. |
| 8,071,060 | B2 | 12/2011 | Ukai et al. |
| 8,079,751 | B2 | 12/2011 | Kapila et al. |
| 8,080,088 | B1 | 12/2011 | Srinivasachar |
| 8,152,970 | B2 * | 4/2012 | Barkdoll ..... C10B 31/10 201/39 |
| 8,236,142 | B2 | 8/2012 | Westbrook et al. |
| 8,266,853 | B2 | 9/2012 | Bloom et al. |
| 8,398,935 | B2 | 3/2013 | Howell, Jr. et al. |
| 9,039,869 | B2 | 5/2015 | Kim et al. |
| 2002/0170605 | A1 | 11/2002 | Shiraishi et al. |
| 2003/0014954 | A1 | 1/2003 | Ronning et al. |
| 2003/0015809 | A1 | 1/2003 | Carson |
| 2006/0102420 | A1 | 5/2006 | Huber et al. |
| 2006/0149407 | A1 | 7/2006 | Markham et al. |
| 2007/0116619 | A1 | 5/2007 | Taylor et al. |
| 2007/0251198 | A1 | 11/2007 | Witter |
| 2008/0028935 | A1 | 2/2008 | Andersson |
| 2008/0169578 | A1 | 7/2008 | Crane et al. |
| 2008/0179165 | A1 | 7/2008 | Chen et al. |
| 2008/0257236 | A1 | 10/2008 | Green |
| 2008/0271985 | A1 | 11/2008 | Yamasaki |
| 2008/0289305 | A1 | 11/2008 | Girondi |
| 2009/0007785 | A1 | 1/2009 | Kimura et al. |
| 2009/0152092 | A1 | 6/2009 | Kim et al. |
| 2009/0162269 | A1 | 6/2009 | Barger et al. |
| 2009/0217576 | A1 | 9/2009 | Kim et al. |
| 2009/0283395 | A1 | 11/2009 | Hippe |
| 2010/0095521 | A1 | 4/2010 | Bertini et al. |
| 2010/0113266 | A1 | 5/2010 | Abe et al. |
| 2010/0115912 | A1 | 5/2010 | Worley et al. |
| 2010/0287871 | A1 | 11/2010 | Bloom et al. |
| 2010/0300867 | A1 | 12/2010 | Kim et al. |
| 2010/0314234 | A1 | 12/2010 | Knoch et al. |
| 2011/0048917 | A1 | 3/2011 | Kim et al. |
| 2011/0120852 | A1 | 5/2011 | Kim et al. |
| 2011/0174301 | A1 | 7/2011 | Haydock et al. |
| 2011/0192395 | A1 | 8/2011 | Kim et al. |
| 2011/0223088 | A1 | 9/2011 | Chang et al. |
| 2011/0253521 | A1 | 10/2011 | Kim |
| 2011/0315538 | A1 | 12/2011 | Kim et al. |
| 2012/0024688 | A1 | 2/2012 | Barkdoll |
| 2012/0030998 | A1 | 2/2012 | Barkdoll et al. |
| 2012/0152720 | A1 | 6/2012 | Reichelt et al. |
| 2012/0180133 | A1 | 7/2012 | Al-Harbi et al. |
| 2012/0228115 | A1 | 9/2012 | Westbrook |
| 2012/0247939 | A1 | 10/2012 | Kim et al. |
| 2012/0305380 | A1 | 12/2012 | Wang et al. |
| 2013/0045149 | A1 | 2/2013 | Miller |
| 2013/0216717 | A1 | 8/2013 | Rago et al. |
| 2013/0220373 | A1 | 8/2013 | Kim |
| 2013/0306462 | A1 | 11/2013 | Kim et al. |
| 2014/0033917 | A1 | 2/2014 | Rodgers et al. |
| 2014/0039833 | A1 | 2/2014 | Sharpe, Jr. et al. |
| 2014/0048402 | A1 | 2/2014 | Quanci et al. |
| 2014/0048404 | A1 | 2/2014 | Quanci et al. |
| 2014/0048405 | A1 | 2/2014 | Quanci et al. |
| 2014/0061018 | A1 | 3/2014 | Sarpen et al. |
| 2014/0083836 | A1 | 3/2014 | Quanci et al. |
| 2014/0182683 | A1 | 7/2014 | Quanci et al. |
| 2014/0183023 | A1 | 7/2014 | Quanci et al. |
| 2014/0183024 | A1 | 7/2014 | Chun et al. |
| 2014/0183026 | A1 | 7/2014 | Quanci et al. |
| 2014/0224123 | A1 | 8/2014 | Walters |
| 2014/0262139 | A1 | 9/2014 | Choi et al. |
| 2014/0262726 | A1 | 9/2014 | West et al. |
| 2015/0122629 | A1 | 5/2015 | Freimuth et al. |
| 2015/0219530 | A1 | 8/2015 | Li et al. |
| 2015/0247092 | A1 | 9/2015 | Quanci et al. |
| 2015/0287026 | A1 | 10/2015 | Yang et al. |
| 2016/0149944 | A1 | 5/2016 | Obermeier et al. |
| 2016/0152897 | A1 | 6/2016 | Quanci et al. |
| 2016/0160123 | A1 | 6/2016 | Quanci et al. |
| 2016/0186063 | A1 | 6/2016 | Quanci et al. |
| 2016/0186064 | A1 | 6/2016 | Quanci et al. |
| 2016/0186065 | A1 | 6/2016 | Quanci et al. |
| 2016/0222297 | A1 | 8/2016 | Choi et al. |
| 2017/0015908 | A1 | 1/2017 | Quanci et al. |

FOREIGN PATENT DOCUMENTS

| | | | | |
|---|---|---|---|---|
| CA | 2822841 | A1 * | 7/2012 | ..... C10B 33/14 |
| CA | 2822857 | A1 * | 7/2012 | |
| CN | 87212113 | U | 6/1988 | |
| CN | 87107195 | A | 7/1988 | |
| CN | 2064363 | U | 10/1990 | |
| CN | 1092457 | A | 9/1994 | |
| CN | 1255528 | A | 6/2000 | |
| CN | 1358822 | A | 7/2002 | |
| CN | 2509188 | Y | 9/2002 | |
| CN | 2521473 | Y | 11/2002 | |
| CN | 2528771 | Y | 1/2003 | |
| CN | 1468364 | A | 1/2004 | |
| CN | 1527872 | A | 9/2004 | |
| CN | 2668641 | Y | 1/2005 | |
| CN | 1957204 | A | 5/2007 | |
| CN | 101037603 | A | 9/2007 | |
| CN | 101058731 | A | 10/2007 | |
| CN | 101157874 | A | 4/2008 | |
| CN | 201121178 | Y | 9/2008 | |
| CN | 100510004 | C | 7/2009 | |
| CN | 101486017 | A | 7/2009 | |
| CN | 101497835 | A | 8/2009 | |
| CN | 101509427 | A | 8/2009 | |
| CN | 102155300 | A | 8/2011 | |
| CN | 202226816 | U | 5/2012 | |
| CN | 102584294 | A | 7/2012 | |
| CN | 103468289 | A | 12/2013 | |
| DE | 212176 | C | 7/1909 | |
| DE | 1212037 | B | 3/1966 | |
| DE | 3315738 | A1 | 11/1983 | |
| DE | 3231697 | C1 | 1/1984 | |
| DE | 3329367 | C1 | 11/1984 | |
| DE | 3328702 | A1 | 2/1985 | |
| DE | 19545736 | A1 | 6/1997 | |

(56) References Cited

FOREIGN PATENT DOCUMENTS

| | | | |
|---|---|---|---|
| DE | 19803455 | C1 | 8/1999 |
| DE | 10122531 | A1 | 11/2002 |
| DE | 10154785 | A1 | 5/2003 |
| DE | 102005015301 | | 10/2006 |
| DE | 102006004669 | | 8/2007 |
| DE | 102006026521 | A1 | 12/2007 |
| DE | 102009031436 | A1 | 1/2011 |
| DE | 102011052785 | B3 | 12/2012 |
| EP | 0208490 | | 1/1987 |
| EP | 2295129 | | 3/2011 |
| FR | 2339664 | A1 | 8/1977 |
| GB | 441784 | A | 1/1936 |
| GB | 606340 | A | 8/1948 |
| GB | 611524 | A | 11/1948 |
| GB | 725865 | A | 3/1955 |
| GB | 871094 | A | 6/1961 |
| JP | 50148405 | A | 11/1975 |
| JP | 54054101 | A | 4/1979 |
| JP | S5453103 | A | 4/1979 |
| JP | 57051786 | A | 3/1982 |
| JP | 57051787 | A | 3/1982 |
| JP | 57083585 | A | 5/1982 |
| JP | 57090092 | A | 6/1982 |
| JP | 58091788 | A | 5/1983 |
| JP | 59051978 | A | 3/1984 |
| JP | 59053589 | A | 3/1984 |
| JP | 59071388 | A | 4/1984 |
| JP | 59108083 | A | 6/1984 |
| JP | 59145281 | A | 8/1984 |
| JP | 60004588 | A | 1/1985 |
| JP | 61106690 | A | 5/1986 |
| JP | 62011794 | A | 1/1987 |
| JP | 62285980 | | 12/1987 |
| JP | 01103694 | A | 4/1989 |
| JP | 01249886 | A | 10/1989 |
| JP | H0319127 | | 1/1991 |
| JP | H04178494 | A | 6/1992 |
| JP | 06264062 | | 9/1994 |
| JP | 07188668 | | 7/1995 |
| JP | 07216357 | | 8/1995 |
| JP | 08127778 | A | 5/1996 |
| JP | H10273672 | A | 10/1998 |
| JP | H11-131074 | | 5/1999 |
| JP | 2000204373 | A | 7/2000 |
| JP | 2001200258 | A | 7/2001 |
| JP | 03197588 | B2 | 8/2001 |
| JP | 2002106941 | A | 4/2002 |
| JP | 200341258 | A | 2/2003 |
| JP | 2003071313 | A | 3/2003 |
| JP | 2003292968 | A | 10/2003 |
| JP | 2003342581 | A | 12/2003 |
| JP | 2005263983 | A | 9/2005 |
| JP | 2007063420 | A | 3/2007 |
| JP | 04159392 | B2 | 10/2008 |
| JP | 2008231278 | A | 10/2008 |
| JP | 2009144121 | A | 7/2009 |
| JP | 2012102302 | A | 5/2012 |
| JP | 2013006957 | A | 1/2013 |
| KR | 960008754 | Y1 | 10/1996 |
| KR | 19990054426 | | 7/1999 |
| KR | 20000042375 | A | 7/2000 |
| KR | 1020050053861 | A | 6/2005 |
| KR | 100737393 | B1 | 7/2007 |
| KR | 10-0797852 | | 1/2008 |
| KR | 10-2011-0010452 | A | 2/2011 |
| KR | 10-0296700 | B1 | 10/2011 |
| KR | 101318388 | B1 | 10/2013 |
| SU | 1535880 | A1 | 1/1990 |
| TW | 201241166 | A | 10/2012 |
| WO | WO-9012074 | A1 | 10/1990 |
| WO | WO-9945083 | A1 | 9/1999 |
| WO | WO2005023649 | | 3/2005 |
| WO | WO2005115583 | | 12/2005 |
| WO | WO-2007103649 | A2 | 9/2007 |
| WO | WO-2008034424 | A1 | 3/2008 |
| WO | WO-2010107513 | A1 | 9/2010 |
| WO | 2011000447 | A1 | 1/2011 |
| WO | WO-2012029979 | A1 | 3/2012 |
| WO | 2013023872 | A1 | 2/2013 |
| WO | WO2014021909 | | 2/2014 |

OTHER PUBLICATIONS

Database WPI, Week 199115, Thomson Scientific, Lond, GB; AN 1991-107552.

Diez, et al., "Coal for Metallurgical Coke Production: Predictions of Coke Quality and Future Requirements for Cokemaking", International Journal of Coal Geology, 2002, vol. 50, Issue 1-4, pp. 389-412.

International Search Report and Written Opinion of International Application No. PCT/US2012/072187; dated Sep. 26, 2013; 13 pages.

JP 03-197588, Inoqu Keizo et al., Method and Equipment for Boring Degassing Hole in Coal Charge in Coke Oven, Japanese Patent (Abstract Only) Aug. 28, 1991.

JP 04-159392, Inoue Keizo et al., Method and Equipment for Opening Hole for Degassing of Coal Charge in Coke Oven, Japanese Patent (Abstract Only) Jun. 2, 1992.

U.S. Appl. No. 14/655,003, filed Jun. 23, 2015, Ball, Mark A., et al.

U.S. Appl. No. 14/655,013, filed Jun. 23, 2015, West, Gary D., et al.

U.S. Appl. No. 14/655,204, filed Jun. 24, 2015, Quanci, John F., et al.

U.S. Appl. No. 14/839,384, filed Aug. 28, 2015, Quanci, John F., et al.

U.S. Appl. No. 14/839,493, filed Aug. 28, 2015, Quanci, John F., et al.

U.S. Appl. No. 14/839,551, filed Aug. 28, 2015, Quanci, John F., et al.

U.S. Appl. No. 14/839,588, filed Aug. 28, 2015, Quanci, John F., et al.

U.S. Appl. No. 14/865,581, filed Sep. 25, 2015, Sarpen, Jacob P., et al.

ASTM D5341-99(2010)e1, Standard Test Method for Measuring Coke Reactivity Index (CRI) and Coke Strength After Reaction (CSR), ASTM International, West Conshohocken, PA, 2010.

Clean coke process: process development studies by USS Engineers and Consultants, Inc., Wisconsin Tech Search, request date Oct. 5, 2011, 17 pages.

Rose, Harold J., "The Selection of Coals for the Manufacture of Coke," American Institute of Mining and Metallurgical Engineers, Feb. 1926, 8 pages.

U.S. Appl. No. 13/205,960, filed Aug. 9, 2011, titled Flat Push Coke Wet Quenching Apparatus and Process.

U.S. Appl. No. 12/849,192, filed Aug. 3, 2010, titled Method and Apparatus for Compacting Coal for a Coal Coking Process.

U.S. Appl. No. 13/631,215, filed Sep. 28, 2012, titled Methods for Handling Coal Processing Emissions and Associated Systems and Devices.

U.S. Appl. No. 13/730,692, filed Dec. 28, 2012, titled Reduced Output Rate Coke Oven Operation With Gas Sharing Providing Extended Process Cycle.

U.S. Appl. No. 13/730,598, filed Dec. 28, 2012, titled Systems and Methods for Improving Quenched Coke Recovery.

U.S. Appl. No. 13/730,735, filed Dec. 28, 2012, titled Systems and Methods for Controlling Air Distribution in a Coke Oven.

U.S. Appl. No. 13/843,166, filed Mar. 15, 2013, titled Methods and Systems for Improved Quench Tower Design.

U.S. Appl. No. 13/829,588, filed Mar. 14, 2013, titled Horizontal Heat Recovery Coke Ovens Having Monolith Crowns.

U.S. Appl. No. 13/588,996, filed Aug. 17, 2012, titled Coke Plant Including Exhaust Gas Sharing.

U.S. Appl. No. 13/589,004, filed Aug. 17, 2012, titled Method and Apparatus for Volatile Matter Sharing in Stamp-Charged Coke Ovens.

U.S. Appl. No. 13/598,394, filed Aug. 29, 2012, titled Method and Apparatus for Testing Coal Coking Properties.

U.S. Appl. No. 14/987,625, filed Jan. 14, 2016, Quanci et al.

(56) References Cited

OTHER PUBLICATIONS

U.S. Appl. No. 15/139,568, filed Apr. 27, 2016, Quanci et al.
Basset, et al., "Calculation of steady flow pressure loss coefficients for pipe junctions," Proc Instn Mech Engrs., vol. 215, Part C. IMechIE 2001.
Costa, et al., "Edge Effects on the Flow Characteristics in a 90 deg Tee Junction," Transactions of the ASME, Nov. 2006, vol. 128, pp. 1204-1217.
Waddell, et al., "Heat-Recovery Cokemaking Presentation," Jan. 1999, pp. 1-25.
Westbrook, "Heat-Recovery Cokemaking at Sun Coke," AISE Steel Technology, Pittsburg, PA, vol. 76, No. 1, Jan. 1999, pp. 25-28.
Yu et al., "Coke Oven Production Technology," Lianoning Science and Technology Press, first edition, Apr. 2014, pp. 356-358.
"Resources and Utilization of Coking Coal in China," Mingxin Shen ed., Chemical Industry Press, first edition, Jan. 2007, pp. 242-243, 247.
U.S. Appl. No. 07/587,742, filed Sep. 25, 1990, now U.S. Pat. No. 5,114,542, titled Nonrecovery Coke Oven Battery and Method of Operation.
U.S. Appl. No. 07/878,904, filed May 6, 1992, now U.S. Pat. No. 5,318,671, titled Method of Operation of Nonrecovery Coke Oven Battery.
U.S. Appl. No. 09/783,195, filed Feb. 14, 2001, now U.S. Pat. No. 6,596,128, titled Coke Oven Flue Gas Sharing.
U.S. Appl. No. 07/886,804, filed May 22, 1992, now U.S. Pat. No. 5,228,955, titled High Strength Coke Oven Wall Having Gas Flues Therein.
U.S. Appl. No. 08/059,673, filed May 12, 1993, now U.S. Pat. No. 5,447,606, titled Method of and Apparatus for Capturing Coke Oven Charging Emissions.
U.S. Appl. No. 08/914,140, filed Aug. 19, 1997, now U.S. Pat. No. 5,928,476, titled Nonrecovery Coke Oven Door.
U.S. Appl. No. 09/680,187, filed Oct. 5, 2000, now U.S. Pat. No. 6,290,494, titled Method and Apparatus for Coal Coking.
U.S. Appl. No. 10/933,866, filed Sep. 3, 2004, now U.S. Pat. No. 7,331,298, titled Coke Oven Rotary Wedge Door Latch.
U.S. Appl. No. 11/424,566, filed Jun. 16, 2006, now U.S. Pat. No. 7,497,930, titled Method and Apparatus for Compacting Coal for a Coal Coking Process.
U.S. Appl. No. 12/405,269, filed Mar. 17, 2009, now U.S. Pat. No. 7,998,316, titled Flat Push Coke Wet Quenching Apparatus and Process.
U.S. Appl. No. 13/205,960, filed Aug. 9, 2011, now U.S. Pat. No. 9,321,965, titled Flat Push Coke Wet Quenching Apparatus and Process.
U.S. Appl. No. 11/367,236, filed Mar. 3, 2006, now U.S. Pat. No. 8,152,970, titled Method and Apparatus for Producing Coke.
U.S. Appl. No. 12/403,391, filed Mar. 13, 2009, now U.S. Pat. No. 8,172,930, titled Cleanable In Situ Spark Arrestor.
U.S. Appl. No. 12/849,192, filed Aug. 3, 2010, now U.S. Pat. No. 9,200,225, titled Method and Apparatus for Compacting Coal for a Coal Coking Process.
U.S. Appl. No. 13/631,215, filed Sep. 28, 2012, now U.S. Pat. No. 9,683,740, titled Methods for Handling Coal Processing Emissions and Associated Systems and Devices.
U.S. Appl. No. 13/730,692, filed Dec. 28, 2012, now U.S. Pat. No. 9,193,913, titled Reduced Output Rate Coke Oven Operation With Gas Sharing Providing Extended Process Cycle.
U.S. Appl. No. 14/921,723, filed Oct. 23, 2015, titled Reduced Output Rate Coke Oven Operation With Gas Sharing Providing Extended Process Cycle.
U.S. Appl. No. 14/655,204, filed Jun. 24, 2015, titled Systems and Methods for Removing Mercury From Emissions.
U.S. Appl. No. 13/830,971, filed Mar. 14, 2013, titled Non-Perpendicular Connections Between Coke Oven Uptakes and a Hot Common Tunnel, and Associated Systems and Methods.
U.S. Appl. No. 13/730,598, filed Dec. 28, 2012, now U.S. Pat. No. 9,238,778, titled Systems and Methods for Improving Quenched Coke Recovery.
U.S. Appl. No. 14/952,267, filed Nov. 25, 2015, titled Systems and Methods for Improving Quenched Coke Recovery.
U.S. Appl. No. 13/730,735, filed Dec. 28, 2012, now U.S. Pat. No. 9,273,249, titled Systems and Methods for Controlling Air Distribution in a Coke Oven.
U.S. Appl. No. 14/655,013, filed Jun. 23, 2015, titled Vent Stack Lids and Associated Systems and Methods.
U.S. Appl. No. 13/843,166, now U.S. Pat. No. 9,273,250, filed Mar. 15, 2013, titled Methods and Systems for Improved Quench Tower Design.
U.S. Appl. No. 15/014,547, filed Feb. 3, 2016, titled Methods and Systems for Improved Quench Tower Design.
U.S. Appl. No. 14/655,003, filed Jun. 23, 2015, titled Systems and Methods for Maintaining a Hot Car in a Coke Plant.
U.S. Appl. No. 13/829,588, now U.S. Pat. No. 9,193,915, filed Mar. 14, 2013, titled Horizontal Heat Recovery Coke Ovens Having Monolith Crowns.
U.S. Appl. No. 15/322,176, filed Dec. 27, 2016, titled Horizontal Heat Recovery Coke Ovens Having Monolith Crowns.
U.S. Appl. No. 15/511,036, filed Mar. 14, 2017, titled Coke Ovens Having Monolith Component Construction.
U.S. Appl. No. 13/589,009, filed Aug. 17, 2012, titled Automatic Draft Control System for Coke Plants.
U.S. Appl. No. 15/139,568, filed Apr. 27, 2016, titled Automatic Draft Control System for Coke Plants.
U.S. Appl. No. 13/588,996, now U.S. Pat. No. 9,243,186, filed Aug. 17, 2012, titled Coke Plant Including Exhaust Gas Sharing.
U.S. Appl. No. 14/959,450, filed Dec. 4, 2015, titled Coke Plant Including Exhaust Gas Sharing.
U.S. Appl. No. 13/589,004, now U.S. Pat. No. 9,249,357, filed Aug. 17, 2012, titled Method and Apparatus for Volatile Matter Sharing in Stamp-Charged Coke Ovens.
U.S. Appl. No. 13/730,673, filed Dec. 28, 2012, titled Exhaust Flow Modifier, Duct Intersection Incorporating the Same, and Methods Therefor.
U.S. Appl. No. 15/281,891, filed Sep. 30, 2016, titled Exhaust Flow Modifier, Duck Intersection Incorporating the Same, and Methods Therefor.
U.S. Appl. No. 13/598,394, now U.S. Pat. No. 9,169,439, filed Aug. 29, 2012, titled Method and Apparatus for Testing Coal Coking Properties.
U.S. Appl. No. 14/865,581, filed Sep. 25, 2015, titled Method and Apparatus for Testing Coal Coking Properties.
U.S. Appl. No. 14/839,384, filed Aug. 28, 2015, titled Coke Oven Charging System.
U.S. Appl. No. 15/443,246, filed Feb. 27, 2017, titled Coke Oven Charging System.
U.S. Appl. No. 14/587,670, filed Dec. 31, 2014, titled Methods for Decarbonizing Coking Ovens, and Associated Systems and Devices.
U.S. Appl. No. 14/984,489, filed Dec. 30, 2015, titled Multi-Modal Beds of Coking Material.
U.S. Appl. No. 14/983,837, filed Dec. 30, 2015, titled Multi-Modal Beds of Coking Material.
U.S. Appl. No. 14/986,281, filed Dec. 31, 2015, titled Multi-Modal Beds of Coking Material.
U.S. Appl. No. 14/987,625, filed Jan. 4, 2016, titled Integrated Coke Plant Automation and Optimization Using Advanced Control and Optimization Techniques.
U.S. Appl. No. 14,839,493, filed Aug. 28, 2015, titled Method and System for Optimizing Coke Plant Operation and Output.
U.S. Appl. No. 14/839,551, filed Aug. 28, 2015, titled Burn Profiles for Coke Operations.
U.S. Appl. No. 14/839,588, filed Aug. 28, 2015, now U.S. Pat. No. 9,708,542, titled Method and System for Optimizing Coke Plant Operation and Output.
U.S. Appl. No. 15/392,942, filed Dec. 28, 2016, titled Method and System for Dynamically Charging a Coke Oven.
U.S. Appl. No. 15/614,525, filed Jun. 5, 2017, titled Methods and Systems for Automatically Generating a Remedial Action in an Industrial Facility.
U.S. Appl. No. 15/322,176, filed Dec. 27, 2016, West et al.
U.S. Appl. No. 15/392,942, filed Dec. 28, 2016, Quanci et al.
U.S. Appl. No. 15/443,246, filed Feb. 27, 2017, Quanci et al.

(56) References Cited

OTHER PUBLICATIONS

U.S. Appl. No. 15/511,036, filed Mar. 14, 2016, West et al.
"Middletown Coke Company HRSG Maintenance BACT Analysis Option 1—Individual Spray Quenches Sun Heat Recovery Coke Facility Process Flow Diagram Middletown Coke Company 100 Oven Case #1-24.5 VM", (Sep. 1, 2009), URL: http://web.archive.org/web/20090901042738/http://epa.ohio.gov/portals/27/transfer/ptiApplication/mcc/new/262504.pdf, (Feb. 12, 2016), XP055249803 [X] 1-13 * p. 7 * * pp. 8-11 *.
Beckman et al., "Possibilities and limits of cutting back coking plant output," Stahl Und Eisen, Verlag Stahleisen, Dusseldorf, DE, vol. 130, No. 8, Aug. 16, 2010, pp. 57-67.
Kochanski et al., "Overview of Uhde Heat Recovery Cokemaking Technology," AISTech Iron and Steel Technology Conference Proceedings, Association for Iron and Steel Technology, U.S., vol. 1, Jan. 1, 2005, pp. 25-32.
Walker D N et al, "Sun Coke Company's heat recovery cokemaking technology high coke quality and low environmental impact", Revue De Metallurgie—Cahiers D'Informations Techniques, Revue De Metallurgie. Paris, FR, (Mar. 1, 2003), vol. 100, No. 3, ISSN 0035-1563, p. 23.
Chinese Office Action in Chinese Application No. 201280077986.1, dated Dec. 21, 2016.
Examination Report in European Application No. 12890800.1; dated Sep. 21, 2017; 5 pages.
"Conveyor Chain Designer Guild", Mar. 27, 2014 (date obtained from wayback machine), Renold.com, Section 4, available online at: http://www.renold/com/upload/renoldswitzerland/conveyor_chain_-_designer_guide.pdf.
Practical Technical Manual of Refractories, Baoyu Hu, etc., Bejing: Metallurgical Industry Press, Chapter 6; 2004, 6-30.
Refractories for Ironmaking and Steelmaking: A History of Battles over High Temperatures; Kyoshi Sugita (Japan, Shaolin Zhang), 1995, p. 160, 2004, 2-29.

* cited by examiner

METHODS AND SYSTEMS FOR IMPROVED COKE QUENCHING

TECHNICAL FIELD

The present technology is generally directed to systems and methods for quenching coke. More specifically, some embodiments are directed to systems and methods for improving the coke quenching process by partially cracking an amount of coke in order to improve the efficiency of the quenching process.

BACKGROUND

Coke is a solid carbon fuel and carbon source used to melt and reduce iron ore in the production of steel. In one process, known as the "Thompson Coking Process," coke is produced by batch feeding pulverized coal to an oven that is sealed and heated to very high temperatures for 24 to 48 hours under closely-controlled atmospheric conditions. Coking ovens have been used for many years to convert coal into metallurgical coke. During the coking process, finely crushed coal is heated under controlled temperature conditions to devolatilize the coal and form a fused mass of coke having a predetermined porosity and strength. Because the production of coke is a batch process, multiple coke ovens are operated simultaneously.

The melting and fusion process undergone by the coal particles during the heating process is an important part of coking. The degree of melting and degree of assimilation of the coal particles into the molten mass determine the characteristics of the coke produced. In order to produce the strongest coke from a particular coal or coal blend, there is an optimum ratio of reactive to inert entities in the coal. The porosity and strength of the coke are important for the ore refining process and are determined by the coal source and/or method of coking.

Coal particles or a blend of coal particles are charged into hot ovens, and the coal is heated in the ovens in order to remove volatile matter ("VM") from the resulting coke. The coking process is highly dependent on the oven design, the type of coal, and conversion temperature used. Typically, ovens are adjusted during the coking process so that each charge of coal is coked out in approximately the same amount of time. Once the coal is "coked out" or fully coked, the coke is removed from the oven and quenched with water to cool it below its ignition temperature. Alternatively, the coke is dry quenched with an inert gas. The quenching operation must also be carefully controlled so that the coke does not absorb too much moisture. Once it is quenched, the coke is screened and loaded into rail cars or trucks for shipment.

Because coal is fed into hot ovens, much of the coal feeding process is automated. In slot-type or vertical ovens, the coal is typically charged through slots or openings in the top of the ovens. Such ovens tend to be tall and narrow. Horizontal non-recovery or heat recovery type coking ovens are also used to produce coke. In the non-recovery or heat recovery type coking ovens, conveyors are used to convey the coal particles horizontally into the ovens to provide an elongate bed of coal.

As the source of coal suitable for forming metallurgical coal ("coking coal") has decreased, attempts have been made to blend weak or lower quality coals ("non-coking coal") with coking coals to provide a suitable coal charge for the ovens. One way to combine non-coking and coking coals is to use compacted or stamp-charged coal. The coal may be compacted before or after it is in the oven. In some embodiments, a mixture of non-coking and coking coals is compacted to greater than fifty pounds per cubic foot in order to use non-coking coal in the coke making process. As the percentage of non-coking coal in the coal mixture is increased, higher levels of coal compaction are required (e.g., up to about sixty-five to seventy-five pounds per cubic foot). Commercially, coal is typically compacted to about 1.15 to 1.2 specific gravity (sg) or about 70-75 pounds per cubic foot.

Once the coal is fully coked out, the resulting coke typically takes the form of a substantially intact coke loaf that is then quenched with water or another liquid. Because the coke loaf stays intact during quenching, the quenching liquid may encounter difficulty penetrating the intact coke loaf. The difficulty can lead to myriad disadvantages including increased water usage, longer quench times that can cripple the throughput of the coke plant, excessive moisture levels in the coke, large variations in coke moisture, and increased risk of melting plant equipment if the coke is not cooled rapidly enough. This difficulty is compounded in the case of stamp charging, in which coal is compacted before it is baked to form coke. Some conventional systems attempt to improve the efficiency of the quench by dropping the coke loaf a vertical distance of several feet to break up the coke loaf prior to quenching. However, such quenching procedures that include vertical drops of several feet often result in a large amount of coke dust that flies out of the container in which it is otherwise contained, while still not significantly improving the efficiency of the quench. This coke dust (as well as other related drawbacks) may necessitate additional capital expenses for adding removal sheds or special collectors to suppress or reclaim the coke dust.

DETAILED DESCRIPTION

Figure 1:
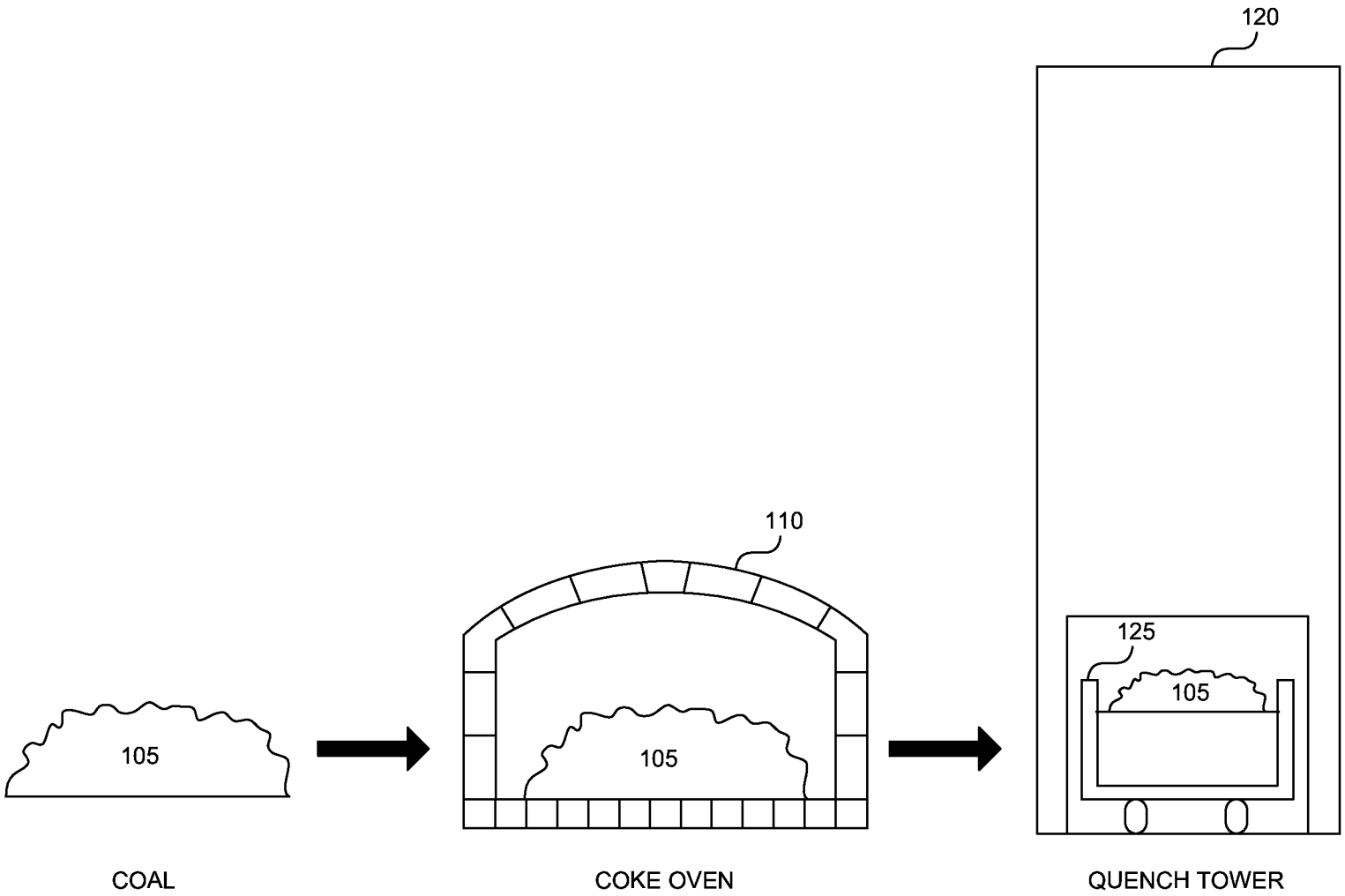
FIG. 1 is a diagram illustrating an overview of a coke making process.
Figure 2A:
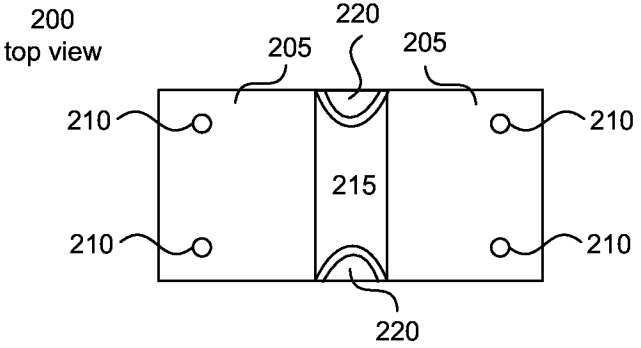
FIG. 2A is a top view of an open bump plate configured in accordance with embodiments of the technology.
Figure 2B:
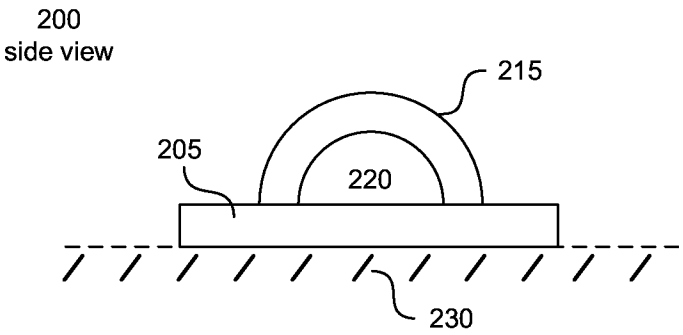
FIG. 2B is a side view of an open bump plate configured in accordance with embodiments of the technology.
Figure 2C:
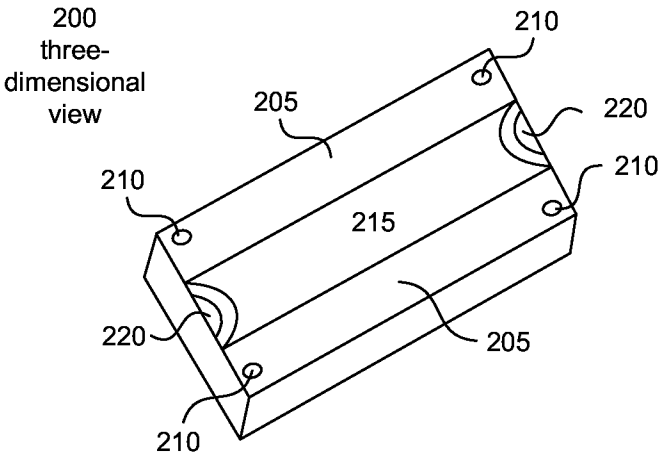
FIG. 2C is a three-dimensional view of an open bump plate configured in accordance with embodiments of the technology.
Figure 2D:
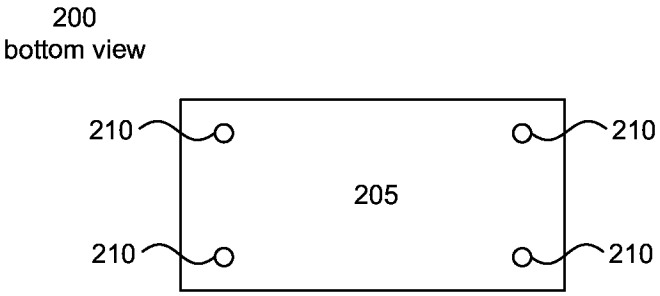
FIG. 2D is a bottom view of an open bump plate configured in accordance with embodiments of the technology.
Figure 3B:
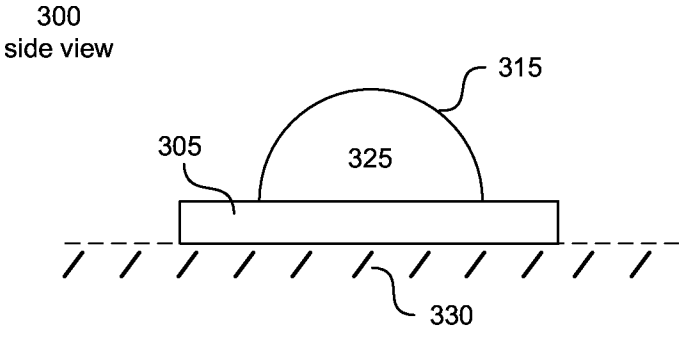
FIG. 3B is a side view of a closed bump plate configured in accordance with embodiments of the technology.
Figure 3D:
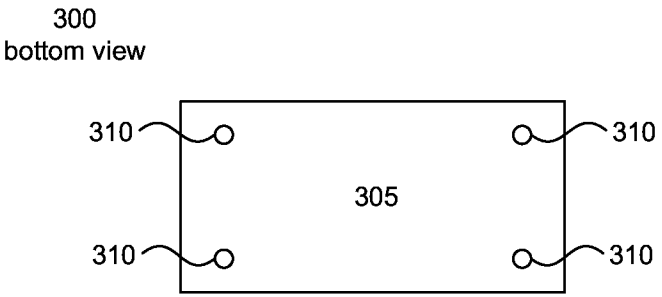
FIG. 3D is a bottom view of a closed bump plate configured in accordance with embodiments of the technology.
Figure 3A:
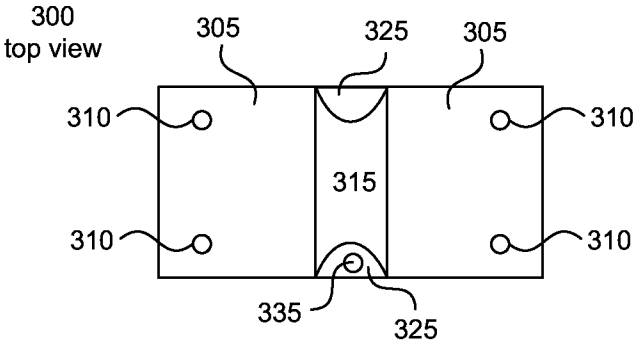
FIG. 3A is a top view of a closed bump plate configured in accordance with embodiments of the technology.
Figure 3C:
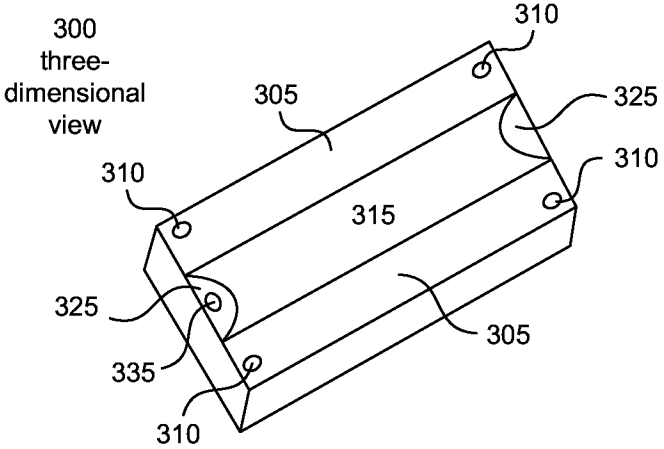
FIG. 3C is a three-dimensional view of a closed bump plate configured in accordance with embodiments of the technology.
Figure 4C:
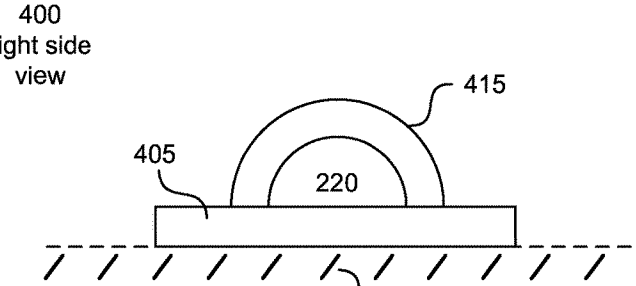
FIG. 4C is a right side view of a hybrid bump plate configured in accordance with embodiments of the technology.
Figure 4B:
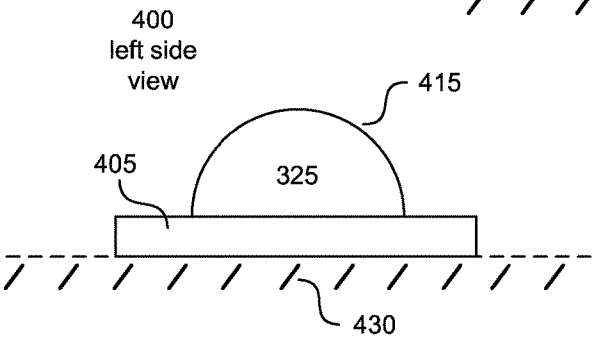
FIG. 4B is a left side view of a hybrid bump plate configured in accordance with embodiments of the technology.
Figure 4E:
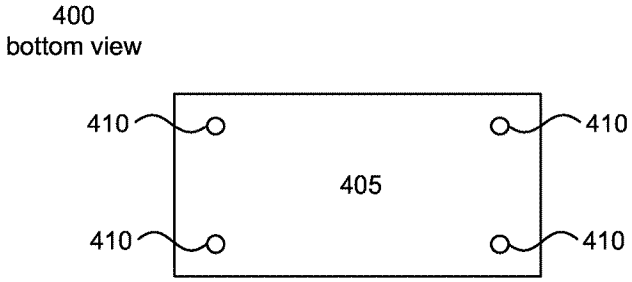
FIG. 4E is a bottom view of a hybrid bump plate configured in accordance with embodiments of the technology.
Figure 4A:
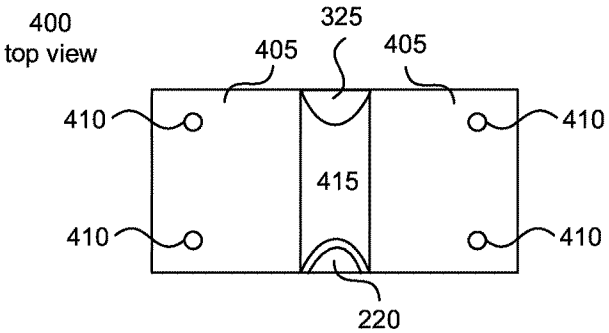
FIG. 4A is a top view of a hybrid bump plate configured in accordance with embodiments of the technology.
Figure 4D:
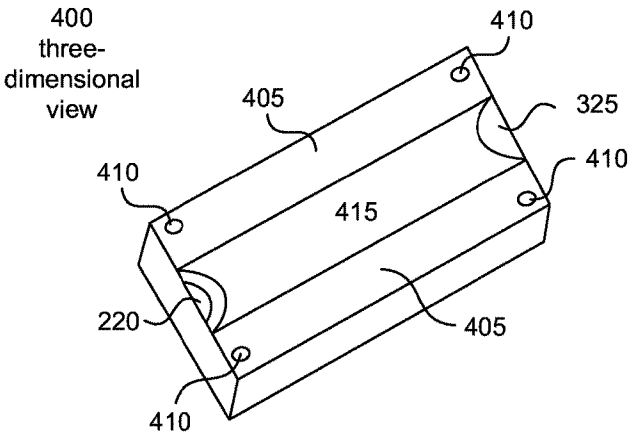
FIG. 4D is a three-dimensional view of a hybrid bump plate configured in accordance with embodiments of the technology.
Figure 5B:
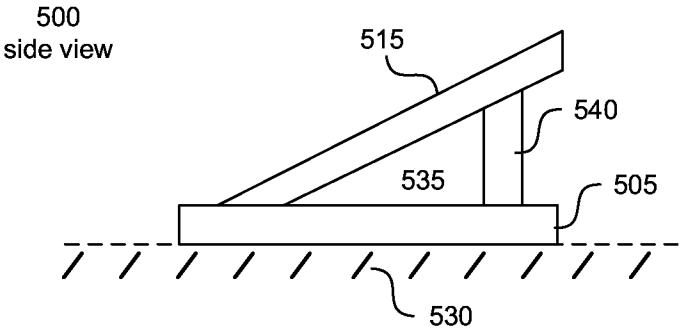
FIG. 5B is a side view of an angle ramp plate configured in accordance with embodiments of the technology.
Figure 5A:
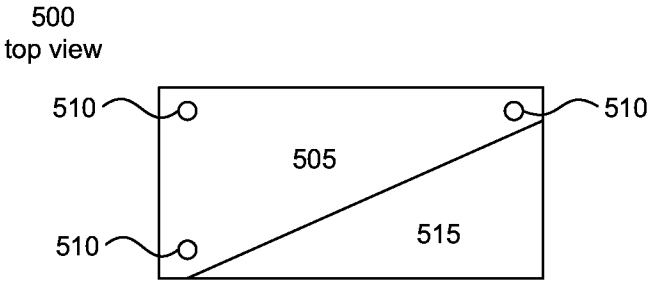
FIG. 5A is a top view of an angle ramp plate configured in accordance with embodiments of the technology.
Figure 5D:
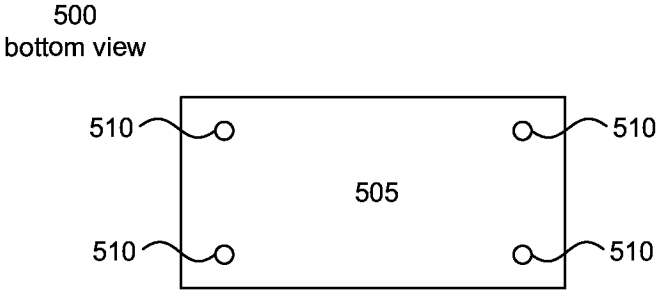
FIG. 5D is a bottom view of an angle ramp plate configured in accordance with embodiments of the technology.
Figure 5C:
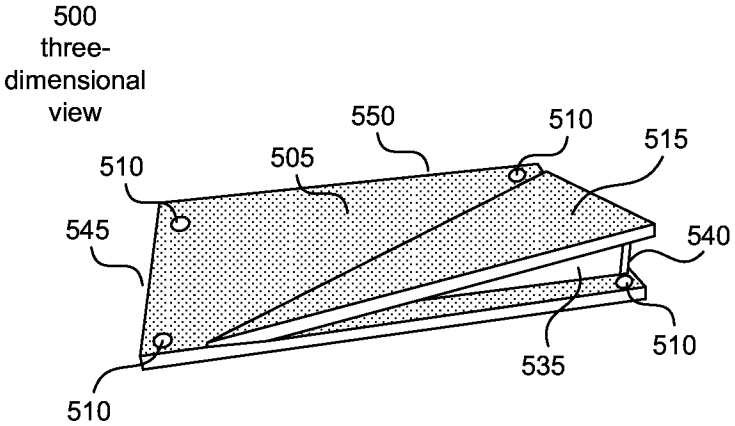
FIG. 5C is a three-dimensional view of an angle ramp plate configured in accordance with embodiments of the technology.
Figure 6A:
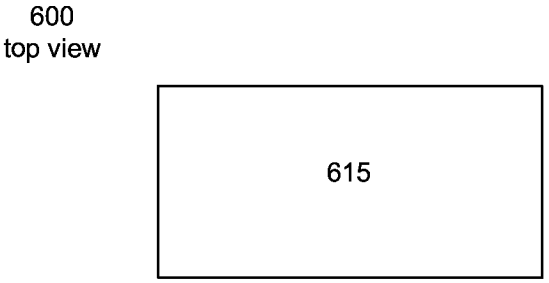
FIG. 6A is a top view of an inclined ramp plate configured in accordance with embodiments of the technology.
Figure 6B:
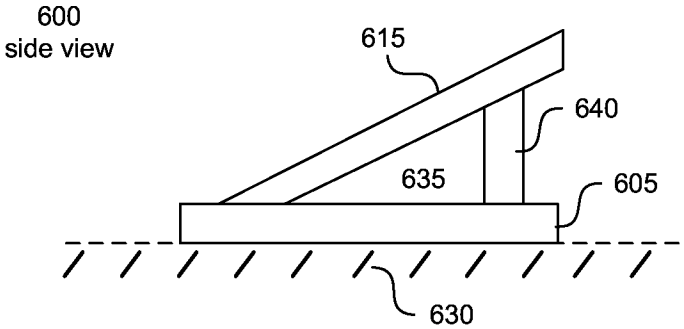
FIG. 6B is a side view of an inclined ramp plate configured in accordance with embodiments of the technology.
Figure 6C:
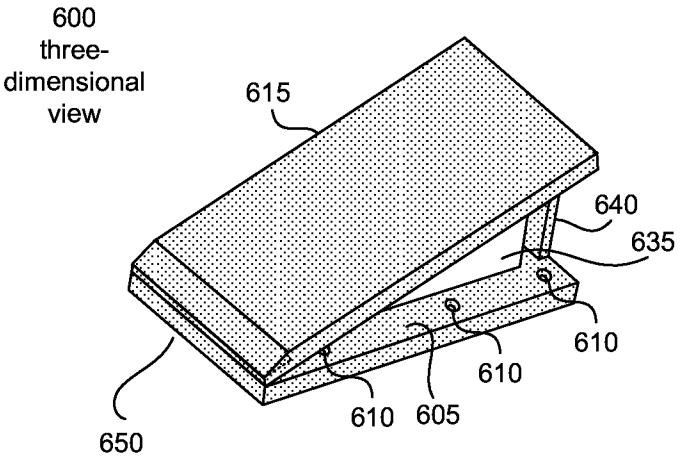
FIG. 6C is a three-dimensional view of an inclined ramp plate configured in accordance with embodiments of the technology.
Figure 6D:
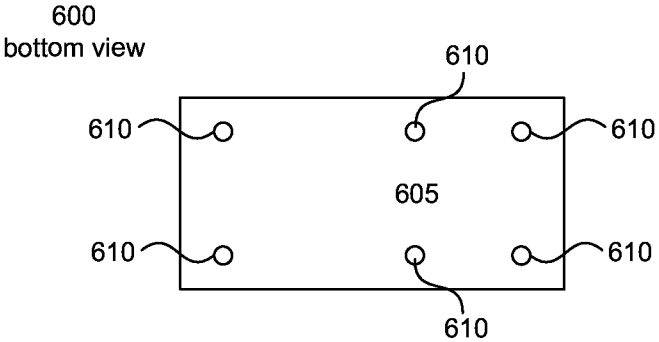
FIG. 6D is a bottom view of an inclined ramp plate configured in accordance with embodiments of the technology.

The present technology describes various embodiments of methods and systems for improved coke quenching. More specifically, some embodiments are directed to methods and systems for improving the coke quenching process by partially cracking coke in order to improve the efficiency of the quenching process. In one embodiment, a coke loaf is partially cracked when placed in vertical communication with a surface over a vertical distance that is less than the height of the coke loaf. In another embodiment, coke is partially cracked when placed in vertical or horizontal communication with one or more uneven surfaces such as a bump plate, an angle ramp plate, an inclined ramp plate, or a combination or hybrid thereof. In another embodiment, a mass of coke is partially cracked when first placed in vertical communication with one or more uneven surfaces such as a bump plate, an angle ramp plate, an inclined ramp plate, or a combination or hybrid thereof, and then placed in horizontal communication with the same or a different uneven surface. In some embodiments, the one or more uneven surfaces may be mounted to a coke oven, train car, hot car, quench car, or combined hot car/quench car. Additionally, in some embodiments, one or more kick plates may be mounted to the tailgate of the train car, hot car, quench car, or combined hot car/quench car to place the rear portions of the coke in further communication with the uneven surface and/or the kick plate when the tailgate is closed. By placing the coke in communication with the uneven surfaces and/or the kick plate, the coke is cracked to yield pieces of coke without generating a significant amount of fly coke. In addition, the cracks in the coke enable liquid used during the quenching process to more efficiently penetrate and lower the temperature of the coke. Accordingly, the present technology improves the quenching process by reducing quench times, reducing liquid usage, minimizing risk to coke plant equipment, and minimizing the amount of fly coke during the quenching process.

Specific details of several embodiments of the technology are described below with reference to FIGS. 1-11B. Other details describing well-known structures and systems often associated with coke making and/or quenching have not been set forth in the following disclosure to avoid unnecessarily obscuring the description of the various embodiments of the technology. Many of the details, dimensions, angles, and other features shown in the Figures are merely illustrative of particular embodiments of the technology. Accordingly, other embodiments can have other details, dimensions, angles, and features without departing from the spirit or scope of the present technology. A person of ordinary skill in the art, therefore, will accordingly understand that the technology may have other embodiments with additional elements, or the technology may have other embodiments without several of the features shown and described below with reference to FIGS. 1-11B.

FIG. 1 is a diagram illustrating an overview of a coke making process. A mass of coal 105 is loaded into coke oven 110 and baked at temperatures that typically exceed 2000 degrees Fahrenheit. Once the coal is "coked out" or fully coked, the resulting coke loaf is removed from the oven and transferred to a train car, hot car, quench car, or combined hot car/quench car 125. In one embodiment, the coke loaf is partially cracked during the transfer by placing the coke loaf in communication with one or more uneven surfaces that are adapted to crack the coke loaf. As will be described in further detail below, the uneven surface may comprise a bump plate (with one or more open or closed ends), an angle ramp plate, an inclined ramp plate, or a hybrid plate. The uneven surface may be mounted to the coke oven, train car, hot car, quench car, combined hot car/quench car, or to any other apparatus that may come into contact with the coke loaf prior to quenching. After the coke loaf is placed in communication with the one or more uneven surfaces, the coke loaf is then transported to quench tower 120 for quenching.

FIGS. 2A-2D are views of an open bump plate 200 configured in accordance with embodiments of the technology. Referring to FIGS. 2A-2D together, open bump plate 200 is configured to partially crack coke that comes into vertical or horizontal communication with the bump plate for more efficient quenching. Open bump plate 200 may be formed out of a variety of materials, including metal or any other material having properties suitable for cracking coke. Open bump plate 200 includes a base 205 that may contain one or more mounting holes 210 extending therethrough for mounting the base to a surface 230 via one or more conventional mounting screws (not shown). Attached to base 205 is a bump 215 that extends from the base and has an elevation that is uneven with respect to the base. Bump 215 may contain an opening 220 at one or both ends.

FIGS. 3A-3D are views of a closed bump plate 300 configured in accordance with embodiments of the technology. Referring to FIGS. 3A-3D together, closed bump plate 300 is configured to partially crack coke that comes into vertical or horizontal communication with the bump plate for more efficient quenching. Closed bump plate 300 may be formed out of a variety of materials, including metal or any other material having properties suitable for cracking coke. Closed bump plate 300 includes a base 305 that may contain one or more mounting holes 310 extending therethrough for mounting the base to a surface 330 via one or more conventional mounting screws (not shown). Attached to base 305 is a bump 315 that extends from the base and has an elevation that is uneven with respect to the base. Bump 315 may comprise an end cap 325 at one or both ends. Sealing one or both ends of the bump may prevent loose coke pieces or other undesirable materials from becoming trapped inside of the bump. Further, in some embodiments, end cap 325 may contain one or more breather holes 335 to allow loose coke pieces, water, air or other undesirable materials to exit the bump without becoming trapped.

FIGS. 4A-4E are views of a hybrid bump plate 400 comprising a bump with one open end and one closed end. Referring to FIGS. 4A-4E together, hybrid bump plate 400 is configured to partially crack coke that comes into vertical or horizontal communication with the bump plate for more efficient quenching. Hybrid bump plate 400 may be formed out of a variety of materials, including metal or any other material having properties suitable for cracking coke. Hybrid bump plate 400 includes a base 405 that may contain one or more mounting holes 410 extending therethrough for mounting the base to a surface 430 via one or more conventional mounting screws (not shown). Attached to base 405 is a bump 415 that extends from the base and has an elevation that is uneven with respect to the base. Bump 415 comprises an end cap 325 at one end. At the other end, bump 415 contains an opening 220.

A person of ordinary skill will appreciate that open bump plate 200, closed bump plate 300, or hybrid bump plate 400 may be fastened to surface 230, surface 330, or surface 430 in a variety of ways that may or may not require the use of mounting holes 210, 310, or 410, including welded or chemically bonded connections.

FIGS. 5A-5D are views of an angle ramp plate 500 configured in accordance with embodiments of the technology. Referring to FIGS. 5A-5D together, angle ramp plate 500 is configured to partially crack coke that comes into vertical or horizontal communication with the angle ramp. Angle ramp plate 500 may be formed out of a variety of materials, including metal or any other material having properties suitable for cracking coke. Angle ramp plate 500 includes a base 505 that may contain one or more mounting holes 510 extending therethrough for mounting the base to a surface 530 via one or more conventional mounting screws (not shown). Angle ramp 515 is attached to base 505 at an angle that is between 90 and 180 degrees with respect to a front portion 545 and a side portion 550 of the base. A person of ordinary skill will appreciate that front portion 545 or side portion 550 may be formed in a variety of shapes, including a linear, curved, or jagged shape.

Angle ramp 515 may rest on one or more support structures situated between angle ramp 515 and base 505. For example, in one embodiment, angle ramp 515 may rest on wedge support 535, which is situated between the angle ramp and the base. Additionally or alternatively, angle ramp 515 may rest on stud support 540, which is situated between the angle ramp and the base. By including wedge support 535 and/or stud support 540, angle ramp plate 500 thereby becomes capable of cracking a larger and heavier amount of coke. A person of ordinary skill will appreciate that angle ramp plate 500 may be fastened to surface 530 in a variety of ways that may or may not require the use of mounting holes 510, including welded or chemically bonded connections. A person of ordinary skill will further appreciate that wedge support 535, stud support 540, or additional structures (not shown) may be used either alone or in various combinations to enclose the area underneath angle ramp 515 to prevent coke, water, steam or other undesirable materials from becoming trapped underneath the angle ramp. A person of ordinary skill will further appreciate that angle ramp 515, wedge support 535, stud support 540, or additional structures (not shown) used to enclose the area underneath the angle ramp may contain one or more breather holes (not shown) to allow coke, water, steam, or other undesirable materials to exit the area underneath the angle ramp.

FIGS. 6A-6D are views of an inclined ramp plate 600 configured in accordance with embodiments of the technology. Referring to FIGS. 6A-6D together, inclined ramp plate 600 is configured to partially crack coke that comes into vertical or horizontal communication with the inclined ramp for more efficient quenching. Inclined ramp plate 600 may be formed out of a variety of materials, including metal or any other material having properties suitable for cracking coke. Inclined ramp plate 600 includes a base 605 that may contain one or more mounting holes 610 extending therethrough for mounting the base to a surface 630 via one or more conventional mounting screws (not shown). Inclined ramp 615 is attached to base 605 at an angle that is between 90 and 180 degrees with respect to the front portion 650 of the base. Inclined ramp 615 may rest on one or more support structures connected between inclined ramp 615 and base 605. For example, in one embodiment, inclined ramp 615 may rest on wedge support 635, which is situated between inclined ramp 615 (on either or both sides of the inclined ramp) and base 605. In another embodiment, inclined ramp 615 may rest on stud support 640, which is situated between the inclined ramp and the base. By including wedge support 635 and/or stud support 640, inclined ramp plate 600 thereby becomes capable of cracking a larger and heavier amount of coke. A person of ordinary skill will appreciate that inclined ramp plate 600 may be fastened to surface 630 in a variety of ways that may or may not require the use of mounting holes 610, including welded or chemically bonded connections.

Figure 7B:
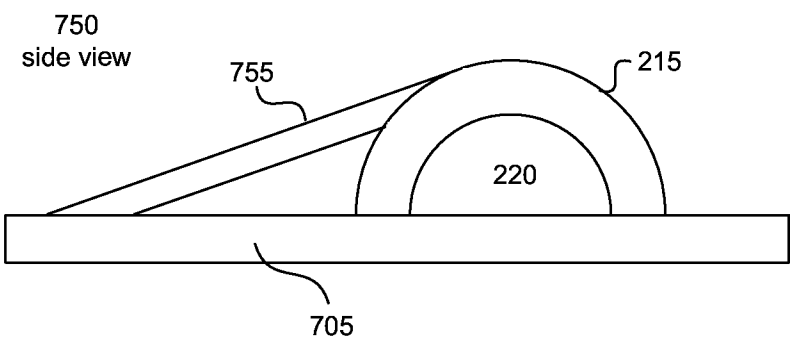
FIG. 7B is a side view of a second embodiment of a hybrid inclined ramp/open bump plate configured in accordance with embodiments of the technology.
Figure 7A:
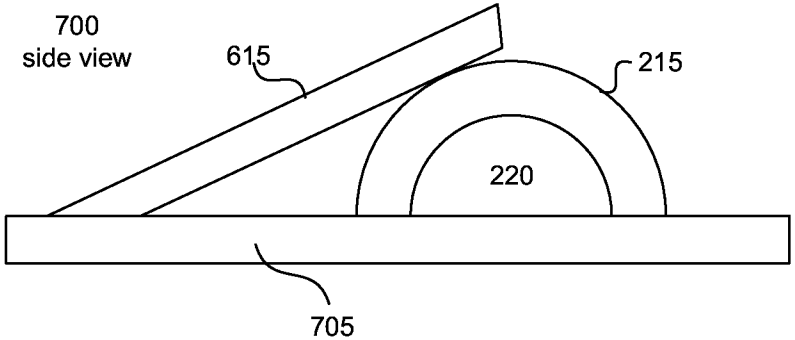
FIG. 7A is a side view of a first embodiment of a hybrid inclined ramp/open bump plate configured in accordance with embodiments of the technology.

A person of ordinary skill will appreciate that a variety of plate designs may be used in accordance with embodiments of the invention, including designs that differ in shape and construction from the plates described herein, designs that incorporate and/or omit specific aspects of various designs described herein, and designs that combine various aspects from different designs described herein to form alternative or hybrid designs. For example, FIGS. 7A and 7B are side views of hybrid inclined ramp/open bump plates 700 and 750. In the embodiment of FIG. 7A, base 705 and inclined ramp 615 of inclined ramp plate 600 may be combined with bump 215 from open bump plate 200 to form a hybrid plate design. In the embodiment of FIG. 7A, coke travels up inclined ramp 615, falls from the top edge of the inclined ramp onto the top of bump 215, travels down the bump, and then falls from the bump onto base 705. In the embodiment of FIG. 7B, base 705 may be combined with bump 215 from open bump plate 200 to form a hybrid plate design. A modified inclined ramp 755 is combined with bump 215 and base 705 to form a hybrid plate design that provides a smoother transition from the top of the inclined ramp to the top of bump 215. Accordingly, in the embodiment of FIG. 7B, coke travels up modified inclined ramp 755, transitions from the top edge of the modified inclined ramp onto the top of bump 215 (without a significant drop or fall from the modified inclined ramp onto the top of the bump), travels down the bump, and then falls from the bump onto base 705.

Figure 8:
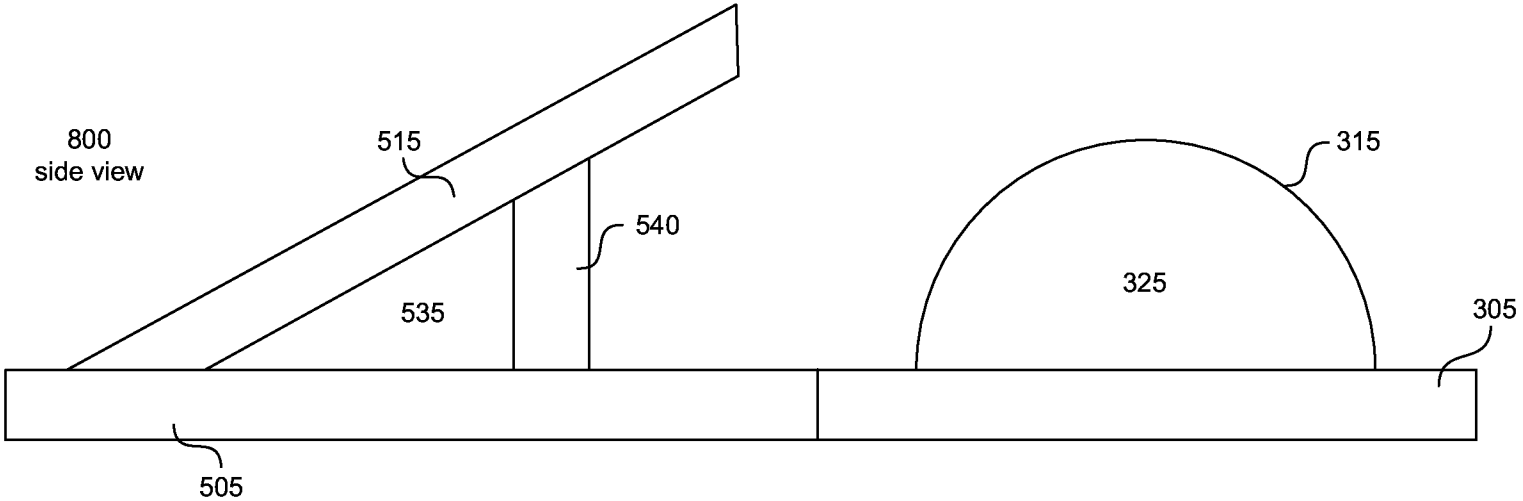
FIG. 8 is a side view of a hybrid angle ramp/closed bump plate configured in accordance with embodiments of the technology.

FIG. 8 is a side view of a hybrid angle ramp/closed bump plate 800. Base 505 and angle ramp 515 of angle ramp plate 500 may be placed in series with bump 315 from closed bump plate 300 to form a hybrid angle ramp/closed bump plate design. A person of ordinary skill will appreciate that the shapes and dimensions of the various components comprising the hybrid designs may be altered (e.g., lengthened, shortened, made taller, joined at different angles, etc.) so that the various components fit together such that the designs are effective at cracking coke that is placed in communication therewith.

Figure 9A:
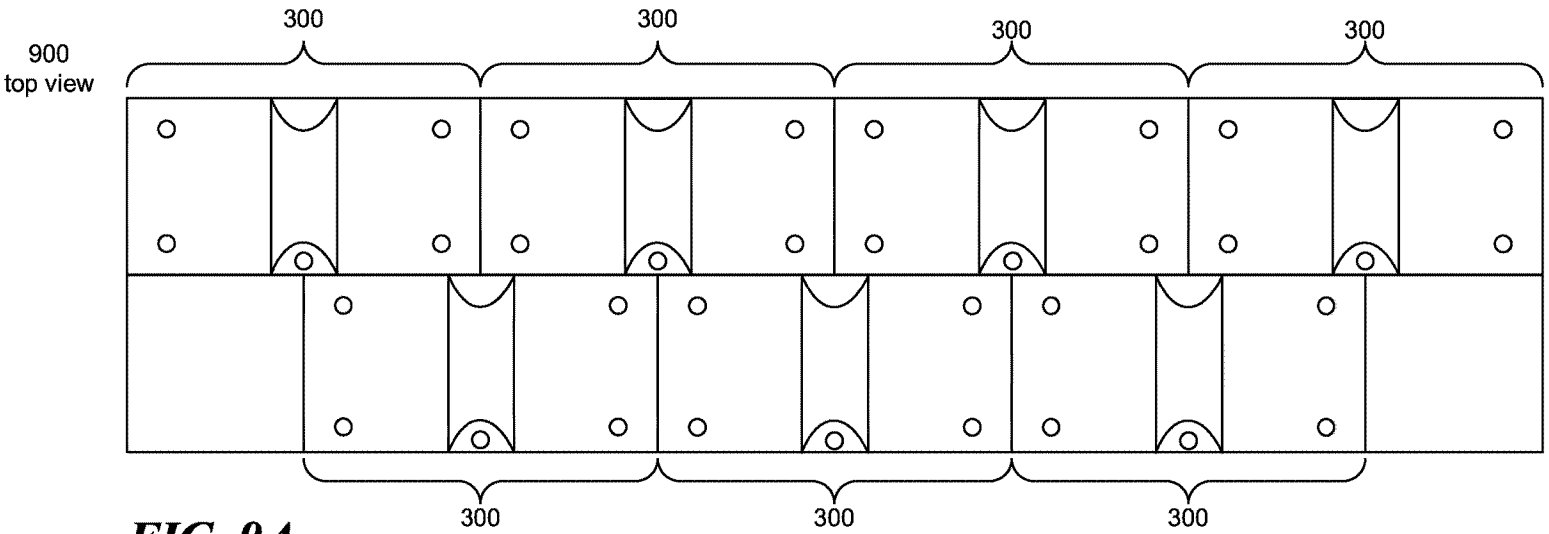
FIG. 9A is a top view of a first bump plate array design in accordance with embodiments of the technology.
Figure 9B:
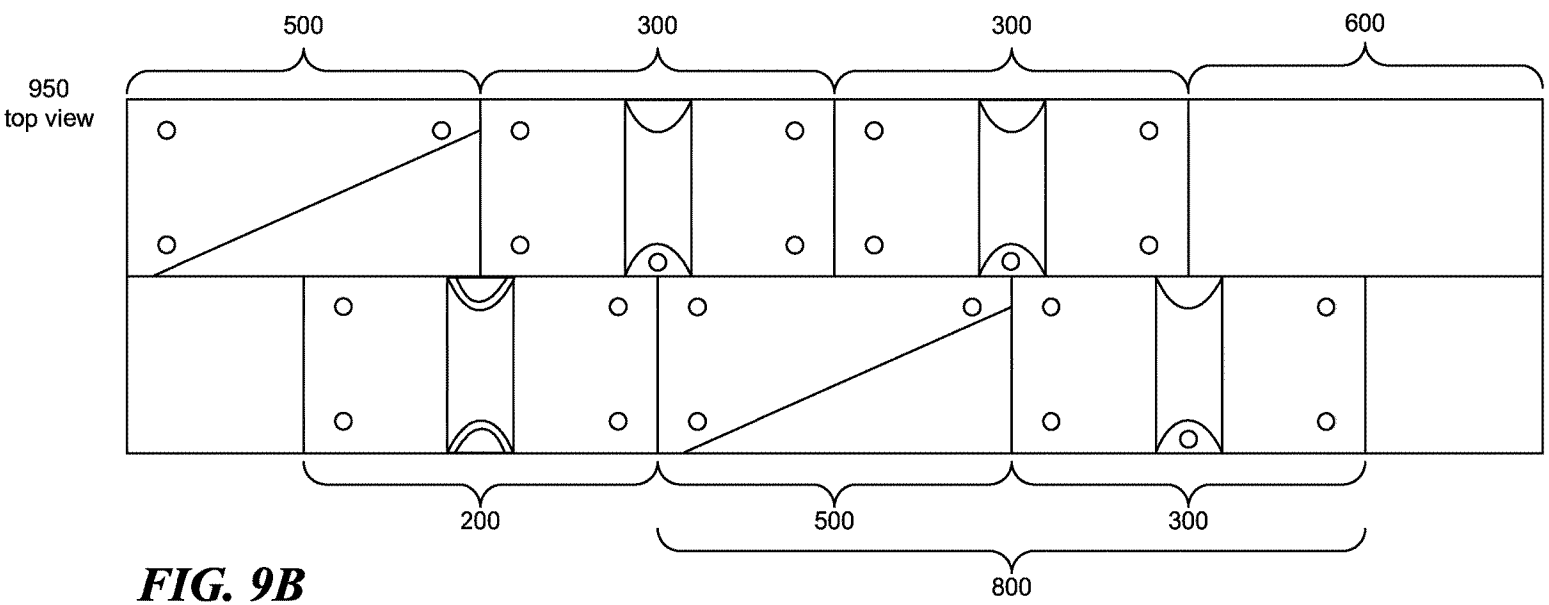
FIG. 9B is a top view of a second bump plate array design in accordance with embodiments of the technology.

One or more plates may be coupled together to form a plate array that covers a larger area than an individual plate and is effective at cracking coke that is placed in vertical or horizontal communication therewith. For example, FIG. 9A is a top view of an arrangement of closed bump plates 300 coupled together to form a plate array 900. As a further example, FIG. 9B is a top view of an arrangement of various different plates coupled together to form plate array 950. In particular, plate array 950 comprises two angle ramp plates 500, three closed bump plates 300, one open bump plate 200, and one inclined ramp plate 600 that are coupled together to form the plate array. Referring to FIG. 9B, angle ramp plate 500 is coupled to closed bump plate 300 in the same or similar fashion as the hybrid angle ramp/closed bump plate 800 of FIG. 8.

Figure 10A:
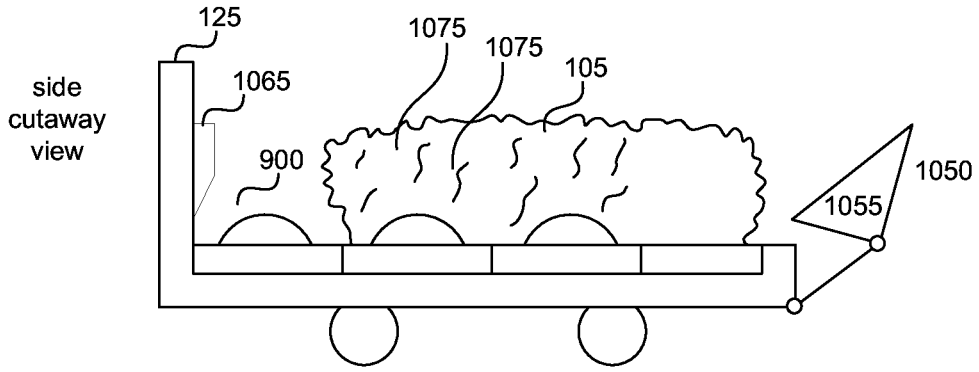
FIG. 10A is a side cutaway view of a train car equipped with an angle kick plate mounted to a tailgate.
Figure 10B:
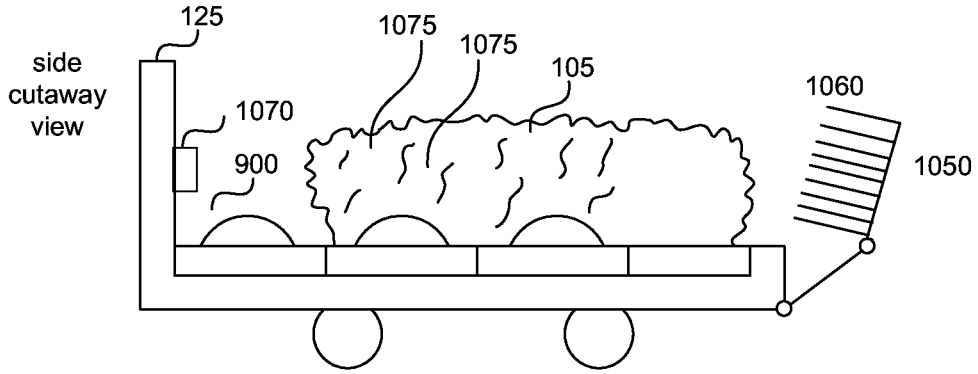
FIG. 10B is a side cutaway view of a train car equipped with a forked kick plate mounted to a tailgate.
Figure 10C:
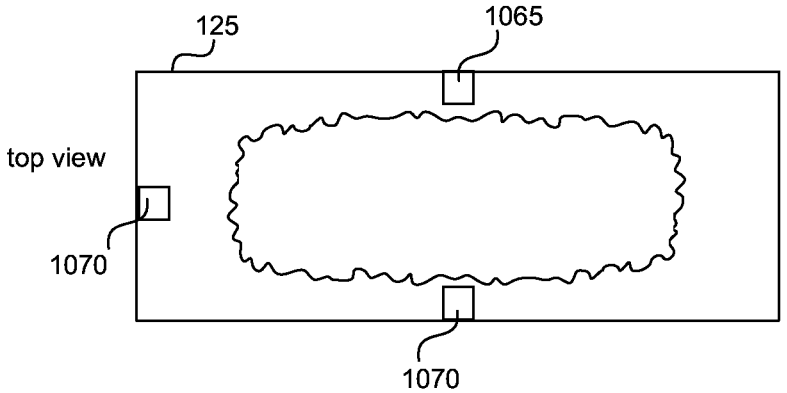
FIG. 10C is a top view of a train car configured in accordance with embodiments of the technology.

FIGS. 10A-10C are views of a train car 125 adapted to partially crack a coke loaf in accordance with embodiments of the technology. Referring to FIGS. 10A-10C together, train car 125 includes closed plate array 900 mounted to the bottom of the train car. A person of ordinary skill will recognize that train car 125 may be a train car, hot car, quench car, or a combined hot car/quench car. Returning to FIGS. 10A-10C together, the front portion of coke 105 has been placed in horizontal communication with the plate array 900 (as indicated by cracks 1075 in the front portion of the coke), while the rear portion of the coke has not been placed in communication with the plate array and therefore remains intact (as indicated by the absence of cracks in the rear portion of the coke). Such a situation may occur when the coke is pushed from a coke oven (or from another train car) into train car 125, for example by a pusher machine (not shown) that does not push the coke completely across the plate array.

To place the remaining coke in communication with the plate array, the tailgate 1050 of the train car may be equipped with a kick plate mounted thereto. In one embodiment, depicted in FIG. 10A, the tailgate includes an angle kick plate 1055. The tailgate may use a pivot and slide mechanism to maneuver the angle kick plate to place the remaining coke in communication with the plate array. As the tailgate is closed, the angle kick plate is placed in communication with coke 105 and further pushes the coke over the plate array, thereby cracking the remaining rear portion of the coke. In another embodiment, depicted in FIG. 10B, tailgate 1050 (which also may use a pivot and slide mechanism to maneuver the forked kick plate) includes a forked kick plate 1060 comprising one or more parallel tines that are situated perpendicular to the tailgate. As the tailgate is closed, the tailgate fork is placed in communication with coke 105 and further pushes the coke over the plate array, thereby cracking the remaining rear portion of the coke. Additionally or alternatively, the forked kick plate may pierce the coke to further crack the rear portion of the coke when the tailgate is closed.

In some embodiments, train car 125 may also include one or more stoppers 1065 or 1070 that prevent the coke from blocking one or more drain gates (not shown) on the train car as the coke is pushed farther inside of the train car. The stoppers may be placed on all sides of the train car, no sides of the train car, or one or more particular sides of the train car. For example, FIG. 10C illustrates an embodiment having stoppers on three sides of the train car while omitting the stopper on the fourth side of the train car. By not allowing the coke to block the drain gates, liquid used during quenching drains from the train car more rapidly, thereby improving the efficiency of the quenching process. A person of ordinary skill will appreciate that the stopper may take a variety of different shapes, such as a trapezoid (e.g., stopper 1065) or a square (e.g., stopper 1070).

Figure 11A:
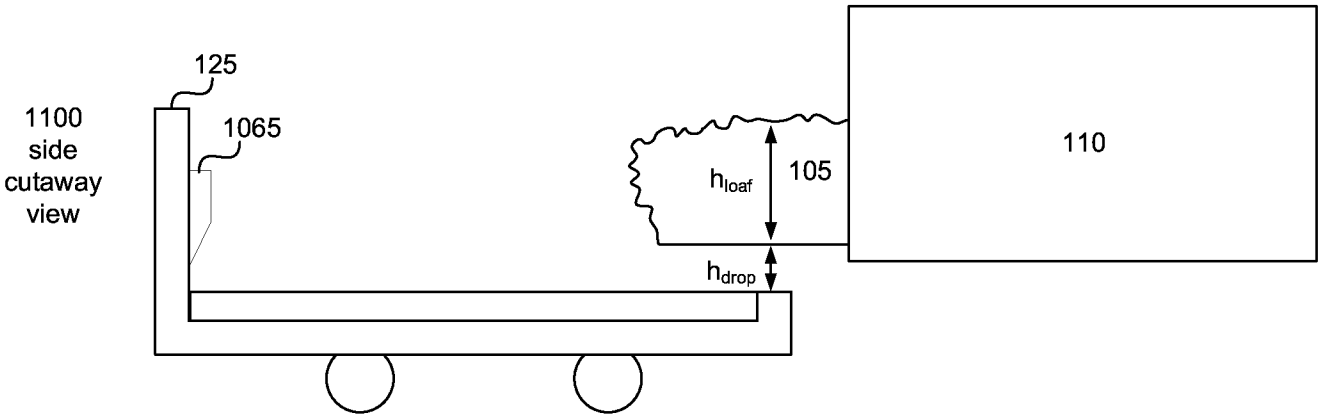
FIG. 11A is a side cutaway view of an embodiment of the technology that cracks coke during transfer from a coke oven to a train car, hot car, quench car, or combined hot car/quench car.
Figure 11B:
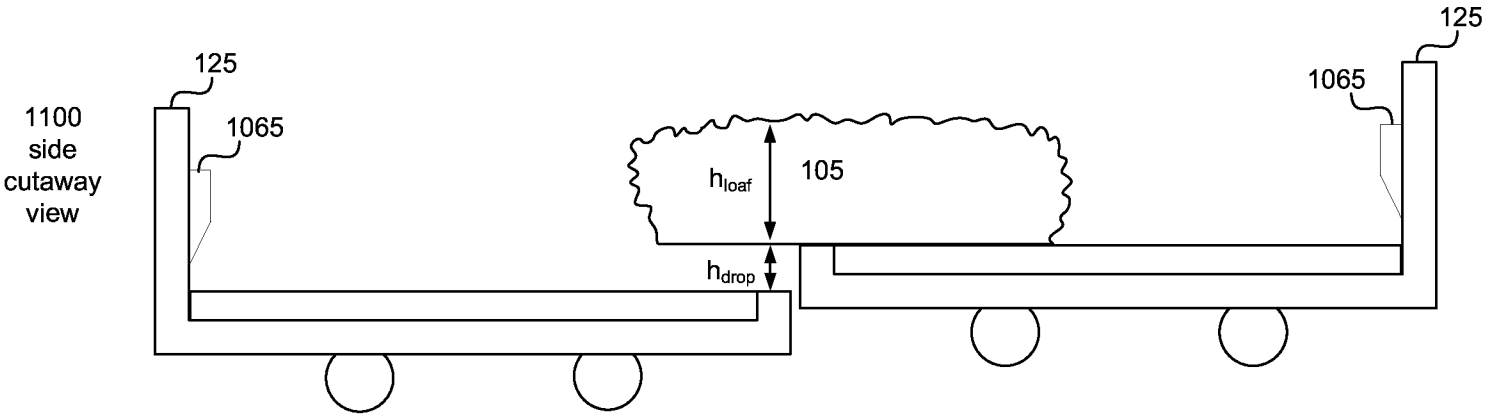
FIG. 11B is a side cutaway view of an embodiment of the technology that cracks coke during transfer from a first train car, hot car, quench car, or combined hot car/quench car to a second train car, hot car, quench car, or combined hot car/quench car.

In addition to cracking coke by placing the coke in horizontal or vertical communication with an uneven surface, other embodiments crack coke prior to quenching by dropping the coke loaf over a distance that is less than the height of the coke loaf. For example, FIG. 11A is a side cutaway view of an embodiment of the technology that cracks coke by dropping coke loaf 105 from coke oven 110 to train car, hot car, quench car, or combined hot car/quench car 125. Similarly, FIG. 11B is a side cutaway view of an embodiment of the technology that cracks coke by dropping coke loaf 105 from a first train car, hot car, quench car, or combined hot car/quench car 125 to a second train car, hot car, quench car, or combined hot car/quench car 125. In both the embodiment of FIG. 11A and the embodiment of FIG. 11B, the coke loaf is dropped a distance $h_{drop}$ that is less than the height $h_{loaf}$ of the coke loaf.

Examples

1. A method of producing quenched coke, comprising:
   disposing an amount of coal into a coke oven located at a first location;
   heating the amount of coal to produce coke;
   cracking the coke at a second location, wherein the cracking comprises placing the coke in communication with an uneven surface having a base and one or more raised portions extending from the base; and
   quenching the coke to form quenched coke.

2. The method of example 1, wherein the one or more raised portions comprises one or more bumps attached to the base, each bump having a rounded portion.

3. The method of example 1, wherein the one or more raised portions comprises one or more angle ramps attached to the base, each angle ramp being attached to the base at an angle that is between 90 and 180 degrees with respect to a front portion and a side portion of the base.

4. The method of example 1, wherein the one or more raised portions comprises one or more inclined ramps attached to a base, each inclined ramp being attached to the base at an angle that is between 90 and 180 degrees with respect to a front portion of the base.

5. The method of example 1, wherein the uneven surface is mounted to a coke oven.

6. The method of example 1, wherein the uneven surface is mounted to a train car.

7. The method of example 1, wherein the uneven surface is mounted to a hot car.

8. The method of example 1, wherein the uneven surface is mounted to a quench car.

9. The method of example 1, wherein the uneven surface is mounted to a combined hot car/quench car.

10. The method of example 1, wherein the amount of coal is stamp charged.

11. The method of example 1, wherein the amount of coal is not stamped charged.

12. The method of example 1, wherein the first location and the second location are substantially parallel.

13. The method of any of example 6, 7, 8, or 9, further comprising cracking the coke by partially or fully closing a tailgate that is attached to the car, wherein the tailgate includes a kick plate mounted thereto, wherein the kick plate comprises an angle wedge, and wherein the partially or fully closing the tailgate places the kick plate in communication with the coke to further crack the coke.

14. The method of any of example 6, 7, 8, or 9, further comprising cracking the coke by partially or fully closing a tailgate that is attached to the car, wherein the tailgate includes a kick plate mounted thereto, wherein the kick plate comprises one or more tines that are substantially perpendicular to the tailgate, and wherein the partially or fully closing the tailgate places the kick plate in communication with the coke to further crack the coke.

15. A system for producing quenched coke, comprising:

a coke oven for receiving an amount of coal and heating the amount of coal to produce coke;

one or more uneven surfaces for cracking the coke when the coke is put into communication with the one or more uneven surfaces, the one or more uneven surfaces having a base and one or more raised portions extending from the base;

a quenching tower for receiving the coke and quenching the coke; and one or more train cars for transporting the coke from the coke oven to the quenching tower.

16. The system of example 15, wherein the one or more raised portions comprises one or more bumps attached to a base, each bump having a rounded portion.

17. The system of example 15, wherein the one or more raised portions comprises one or more angle ramps attached to a base, each angle ramp being attached to the base at an angle that is between 90 and 180 degrees with respect to a front portion and a side portion of the base.

18. The system of example 15, wherein the one or more raised portions comprises one or more inclined ramps attached to a base, each inclined ramp being attached to the base at an angle that is between 90 and 180 degrees with respect to a front portion of the base.

19. The system of example 15, wherein the uneven surface is mounted to a coke oven.

20. The system of example 15, wherein the uneven surface is mounted to a hot car.

21. The system of examples 15, wherein the uneven surface is mounted to a train car.

22 The system of example 15, wherein the uneven surface is mounted to a quench car.

23. The system of example 15, wherein the uneven surface is mounted to a combined hot car/quench car.

24. The system of example 15, wherein the amount of coal is stamp charged.

25. The system of example 15, wherein the amount of coal is not stamped charged.

26. The system of example 15, wherein the coke oven and the uneven surfaces are substantially parallel.

27. The system of any of examples 20, 21, 22, or 23, further comprising cracking the coke by partially or fully closing a tailgate that is attached to the car, wherein the tailgate includes a kick plate mounted thereto, wherein the kick plate comprises an angle wedge, and wherein the partially or fully closing the tailgate places the kick plate in communication with the coke to further crack the coke.

28. The system of any of examples 20, 21, 22, or 23, further comprising cracking the coke by partially or fully closing a tailgate that is attached to the car, wherein the tailgate includes a kick plate mounted thereto, wherein the kick plate comprises one or more tines that are substantially perpendicular to the tailgate, and wherein the partially or fully closing the tailgate places the kick plate in communication with the coke to further crack the coke.

29. A method of producing quenched coke, comprising:

disposing an amount of coal onto a coke oven;

heating the amount of coal to produce a coke loaf having a height;

transferring the coke loaf from a first location having a first elevation to a second location having a second elevation, wherein the difference in height between the first elevation and the second elevation is less than the height of the coke cake, and further wherein the transferring includes cracking the coke loaf by placing the coke loaf in vertical communication with the second location; and quenching the coke to form quenched coke.

30. The method of example 29, wherein the first location is a coke oven and the second location is a train car.

31. The method of example 29, wherein the first location is a coke oven and the second location is a hot car.

32. The method of example 29, wherein the first location is a coke oven and the second location is a quench car.

33. The method of example 29, wherein the first location is a coke oven and the second location is a combined hot car/quench car.

34. The method of example 29, wherein the first location is a first train car and the second location is a second train car.

35. The method of example 29, wherein the first location is a hot car and the second location is a quench car.

36. The method of example 29, wherein the amount of coal is stamp charged.

37. The method of example 29, wherein the amount of coal is not stamped charged.

38. A method of producing quenched coke, comprising:

disposing an amount of coal into a coke oven;

heating the amount of coal to produce coke;

transporting the coke from the coke oven to a train car, wherein the transporting includes cracking the coke by placing the coke in communication with an uneven surface mounted in the train car as the coke travels from the coke oven to the train car, wherein the uneven surface has a base and one or more raised portions extending from the base;

transporting the cracked coke to a quench tower; and quenching the coke to form quenched coke.

From the foregoing it will be appreciated that, although specific embodiments of the technology have been described herein for purposes of illustration, various modifications may be made without deviating from the spirit and scope of the technology. Further, certain aspects of the new technology described in the context of particular embodiments may be combined or eliminated in other embodiments. Moreover, while advantages associated with certain embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein. Thus, the disclosure is not limited except as by the appended claims.

We claim:

1. A method of producing quenched coke, comprising:

disposing an amount of coal into a coke oven located at a first location;

heating the amount of coal to produce a coke loaf;

cracking the coke loaf at a second location, wherein the cracking comprises forming a plurality of separate, open cracks that extend transversely across widths of the coke loaf, along fault lines in the coke loaf, by moving the coke loaf along a pathway over an uneven surface having a base and one or more raised portions extending upwardly from the base in a static position with respect to the base; at least one of the one or more raised portions having a forward surface that inclines along the pathway, upwardly toward a linear apex that extends transversely to the pathway; wherein the plurality of separate, transverse, open cracks form along lengths of the coke loaf that are moved at least partially over the one or more raised portions; and quenching the coke to form quenched coke.

2. The method of claim 1, wherein the forward surface of the at least one of the one or more raised portions is convexly curved from the base to the linear apex.

3. The method of claim 1, wherein at least one of the one or more raised portions comprises one or more angle ramps attached to the base, each angle ramp being attached to the base at an angle that is between 90 and 180 degrees with respect to a front portion and a side portion of the base.

4. The method of claim 1, wherein at least one of the one or more raised portions comprises one or more inclined ramps attached to a base, each inclined ramp being attached to the base at an angle that is between 90 and 180 degrees with respect to a front portion of the base.

5. The method of claim 1, wherein the uneven surface is mounted to a coke oven.

6. The method of claim 1, wherein the uneven surface is mounted to a train car.

7. The method of claim 1, wherein the uneven surface is coupled to a hot car.

8. The method of claim 1, wherein the uneven surface is coupled to a quench car.

9. The method of claim 1, wherein the uneven surface is coupled to a combined hot car/quench car.

10. The method of claim 1, wherein the amount of coal is stamp charged.

11. The method of claim 1, wherein the amount of coal is not stamped charged.

12. The method of claim 1, wherein the first location and the second location are substantially parallel.

13. The method of claim 1 further comprising cracking the coke loaf by partially or fully closing a tailgate that is attached to the car, wherein the tailgate includes a kick plate mounted thereto, wherein the kick plate comprises an angle wedge, and wherein the partially or fully closing the tailgate places the kick plate in communication with the coke loaf in a manner that further pushes the coke loaf along the uneven surface to further crack the coke loaf.

14. The method of claim 1 further comprising cracking the coke loaf by partially or fully closing a tailgate that is attached to the car, wherein the tailgate includes a kick plate mounted thereto, wherein the kick plate comprises one or more tines that are substantially perpendicular to the tailgate, and wherein the partially or fully closing the tailgate places the kick plate in communication with the coke loaf to at least one of: a) pierce the coke loaf and crack an end portion of the coke loaf; and b) further push the coke loaf along the uneven surface to further crack the coke loaf.

15. A method of producing quenched coke, comprising:

disposing an amount of coal onto a coke oven;

heating the amount of coal to produce a coke loaf having a height;

transferring the coke loaf from a first location having a first elevation to a second location having a second elevation, wherein the first location and second location are placed in a static position with respect to one another and the difference in height between the first elevation and the second elevation is less than the height of the coke loaf, and further wherein the transferring includes cracking the coke loaf by moving the coke loaf from the first location to the second location, placing the coke loaf in vertical communication with the second location;

forming a plurality of separate, open cracks that extend transversely across widths of the coke loaf, along fault lines in the coke loaf, by moving the coke loaf along a pathway over an uneven surface having a base and one or more raised portions extending upwardly from the base in a static position with respect to the base; at least one of the one or more raised portions having a forward surface that inclines along the pathway, upwardly toward a linear apex that extends transversely to the pathway; wherein the plurality of separate, transverse, open cracks form along lengths of the coke loaf that are moved at least partially over the one or more raised portions; and quenching the coke loaf to form quenched coke.

16. The method of claim 15, wherein the first location is a coke oven and the second location is a train car.

17. The method of claim 15, wherein the first location is a coke oven and the second location is a hot car.

18. The method of claim 15, wherein the first location is a coke oven and the second location is a quench car.

19. The method of claim 15, wherein the first location is a coke oven and the second location is a combined hot car/quench car.

20. The method of claim 15, wherein the first location is a first train car and the second location is a second train car.

21. The method of claim 15, wherein the first location is a hot car and the second location is a quench car.

22. The method of claim 15, wherein the amount of coal is stamp charged.

23. The method of claim 15, wherein the amount of coal is not stamped charged.

* * * * *